US011150587B2

(12) United States Patent
Mita et al.

(10) Patent No.: US 11,150,587 B2
(45) Date of Patent: Oct. 19, 2021

(54) SHEET PROCESSING APPARATUS AND IMAGE FORMING SYSTEM

(71) Applicant: CANON KABUSHIKI KAISHA, Tokyo (JP)

(72) Inventors: Takuro Mita, Yokohama (JP); Nobutoshi Sugai, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/699,822

(22) Filed: Dec. 2, 2019

(65) Prior Publication Data

US 2020/0183316 A1 Jun. 11, 2020

(30) Foreign Application Priority Data

Dec. 5, 2018 (JP) ..... JP2018-228587
Sep. 19, 2019 (JP) ..... JP2019-170399

(51) Int. Cl.

*B65H 29/66* (2006.01)
*G03G 15/00* (2006.01)
*B65H 37/04* (2006.01)
*B65H 29/60* (2006.01)

(52) U.S. Cl.

CPC ..... *G03G 15/6541* (2013.01); *B65H 29/60* (2013.01); *B65H 37/04* (2013.01); *G03G 15/6529* (2013.01)

(58) Field of Classification Search

CPC ..... G03G 15/5429; G03G 15/6541; B65H 29/60; B65H 29/66; B65H 29/6609; B65H 29/6681; B65H 37/04

See application file for complete search history.

(56) References Cited

U.S. PATENT DOCUMENTS 5,112,034 A 5/1992 Uto et al.
5,457,079 A 10/1995 Itabashi et al.
5,788,821 A 8/1998 Itabashi et al.
6,332,606 B1 * 12/2001 Seki ..... B42C 1/12 270/58.08
7,111,839 B2 * 9/2006 Nishimura ..... B65H 29/20 270/58.01
7,900,905 B2 3/2011 Kiriyama

FOREIGN PATENT DOCUMENTS

JP H06-99070 B2 12/1994
JP 2006-193320 A 7/2006
JP 2008-266019 A 11/2008

* cited by examiner

*Primary Examiner* — Leslie A Nicholson, III
(74) *Attorney, Agent, or Firm* — Venable LLP

(57) ABSTRACT

A sheet processing apparatus includes a first sheet conveyance path, a second sheet conveyance path that branches from the first sheet conveyance path at a branch portion on the first sheet conveyance path and merges with the first sheet conveyance path at a merging portion, and a control unit. The control unit controls a guide unit so as to guide a first sheet conveyed first in the sheet bundle to be processed by a sheet processing unit to the second sheet conveyance path, and guide a second sheet following the first sheet to the first sheet conveyance path to merge the first and second sheets in an overlapping manner at the merging portion, and guide at least one of sheets following the second sheet among a plurality of sheets constituting the sheet bundle to the second sheet conveyance path.

11 Claims, 15 Drawing Sheets

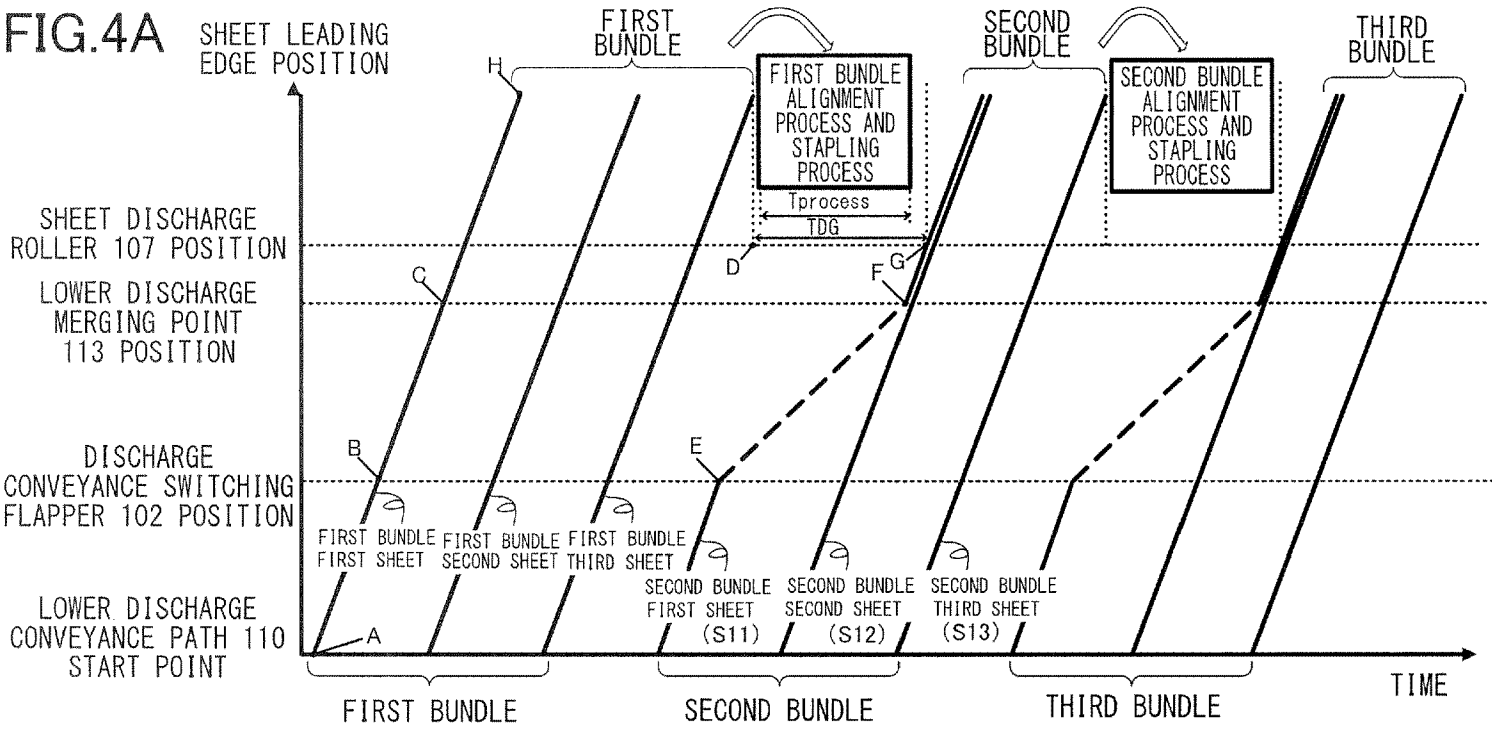
FIG.4A
SHEET LEADING EDGE POSITION
SHEET DISCHARGE ROLLER 107 POSITION
LOWER DISCHARGE MERGING POINT 113 POSITION
DISCHARGE CONVEYANCE SWITCHING FLAPPER 102 POSITION
LOWER DISCHARGE CONVEYANCE PATH 110 START POINT
FIRST BUNDLE
SECOND BUNDLE
THIRD BUNDLE
FIRST BUNDLE ALIGNMENT PROCESS AND STAPLING PROCESS
SECOND BUNDLE ALIGNMENT PROCESS AND STAPLING PROCESS
Tprocess
TDG
A
B
C
D
E
F
G
H
FIRST BUNDLE FIRST SHEET
FIRST BUNDLE SECOND SHEET
FIRST BUNDLE THIRD SHEET
SECOND BUNDLE FIRST SHEET (S11)
SECOND BUNDLE SECOND SHEET (S12)
SECOND BUNDLE THIRD SHEET (S13)
TIME

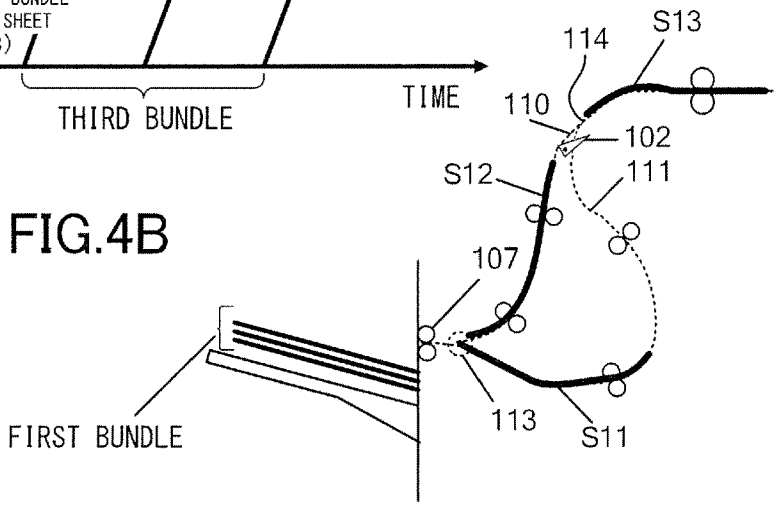
FIG.4B
S13
114
102
111
110
S12
107
113
S11
FIRST BUNDLE

SHEET PROCESSING APPARATUS AND IMAGE FORMING SYSTEM

BACKGROUND OF THE INVENTION

Field of the Invention

The present invention relates to a sheet processing apparatus and an image forming system for processing a sheet.

Description of the Related Art

Hitherto, a sheet processing apparatus conveys sheets discharged from an image forming apparatus such as a printer or a copying machine onto a processing tray, and then performs edge alignment (hereinafter, referred to as alignment) and binding operations (hereinafter, referred to as stapling process) of a sheet bundle accumulated on the tray. While a sheet is being processed on the processing tray, subsequent sheets cannot be sent to the processing tray, and therefore the sheets discharged from the image forming apparatus are temporarily stored in the sheet processing apparatus until the processing on the processing tray is completed. However, some apparatus have been devised so as not to reduce the productivity of the entire system.

For example, according to the sheet processing apparatus described in JP-B-6-99070, a normal conveyance path and a second conveyance path are provided as conveyance paths following the processing tray. While a preceding sheet is being processed on the processing tray, the succeeding first sheet is conveyed to the second conveyance path, and the first sheet is retained by a conveyance roller stopped by an electromagnetic clutch. The second sheet following the first sheet is conveyed to the normal path, conveying of the retained first sheet is resumed according to the second sheet, and the first sheet and the second sheet are sent to the sheet process tray in a state where the first and second sheets overlap each other, whereby the arrival of the first sheet on the processing tray is delayed. In this way, even when a sheet is being processed in the sheet process tray, a sheet can be sent from the image forming apparatus to the sheet processing apparatus, and therefore a sheet post-processing job can be executed without reducing the productivity of the entire system.

In the case where the processing time of the preceding sheet in the processing tray is longer, a plurality of sheets subsequent to the first sheet are also retained in the second conveyance path, whereby the post-processing job can be performed without reducing the productivity of the entire system.

However, in the example of the above JP-B-6-99070, while the preceding sheet is being processed in the processing tray, the succeeding first sheet is conveyed to the second conveyance path, and the succeeding second sheet and thereafter are conveyed to the normal conveyance path. Even when the processing time in the processing tray of the preceding sheet is long, during processing on the processing tray, a plurality of subsequent sheets are conveyed to the second conveyance path, but in the case where the processing is not performed on the processing tray, all remaining sheets are conveyed to the normal conveyance path. That is, since only the units of the first few pages to be post-processed among the sheets to be conveyed to the processing tray are conveyed to the second conveyance path, it is conceivable that the difference in the amount of paper passing between the normal conveyance path and the second conveyance path increases as the number of cumulative sheets conveyed to the processing tray increases. As a result, there is a problem that the influence on the sheet conveying performance due to the wear of the conveyance rollers in the paths and the accumulation of paper dust is biased toward the normal conveyance path compared to the second conveyance path.

An object of the present invention is to provide a sheet processing apparatus and an image forming system that distribute and convey sheets between a first sheet conveyance path and a second sheet conveyance path.

SUMMARY OF THE INVENTION

According to a first aspect of the invention, a sheet processing apparatus includes a sheet supporting portion configured to support a discharged sheet, a sheet processing unit configured to perform processing on a sheet bundle composed of a plurality of sheets discharged on the sheet supporting portion, a first sheet conveyance path for guiding the sheet to the sheet supporting portion, a second sheet conveyance path that branches from the first sheet conveyance path at a branch portion on the first sheet conveyance path and merges with the first sheet conveyance path at a merging portion upstream, in a sheet conveying direction, of a discharge port to the sheet supporting portion, a guide unit configured to selectively guide the sheet to the first sheet conveyance path or the second sheet conveyance path in the branch portion, and a control unit configured to control the guide unit. The control unit controls the guide unit so as to guide a first sheet conveyed first in the sheet bundle to be processed by the sheet processing unit to the second sheet conveyance path, and guide a second sheet following the first sheet to the first sheet conveyance path to merge the first and second sheets in an overlapping manner at the merging portion, and guide at least one of sheets following the second sheet among a plurality of sheets constituting the sheet bundle to the second sheet conveyance path.

According to a second aspect of the invention, a sheet processing apparatus includes a sheet supporting portion configured to support a discharged sheet, a sheet processing unit configured to perform processing on a sheet bundle composed of a plurality of sheets discharged on the sheet supporting portion, a first sheet conveyance path for guiding the sheet to the sheet supporting portion, a second sheet conveyance path that branches from the first sheet conveyance path at a branch portion on the first sheet conveyance path and merges with the first sheet conveyance path at a merging portion upstream, in a sheet conveying direction, of a discharge port to the sheet supporting portion, a guide unit configured to selectively guide the sheet to the first sheet conveyance path or the second sheet conveyance path in the branch portion, and a control unit configured to control the guide unit. The control unit is configured to be switchable between a first mode in which the guide unit is controlled such that the number of sheets to be discharged to the sheet supporting portion via the first sheet conveyance path among a plurality of sheets constituting the sheet bundle is larger than the number of sheets to be discharged to the sheet supporting portion via the second sheet conveyance path and a second mode in which the guide unit is controlled such that the number of sheets to be discharged to the sheet supporting portion via the second sheet conveyance path among the plurality of sheets constituting the sheet bundle is larger than the number of sheets to be discharged to the sheet supporting portion via the first sheet conveyance path, in units of the sheet bundle.

According to a third aspect of the invention, a sheet processing apparatus includes a sheet supporting portion configured to support a discharged sheet, a sheet processing unit configured to perform processing on a sheet bundle composed of a plurality of sheets discharged on the sheet supporting portion, a first sheet conveyance path for guiding the sheet to the sheet supporting portion, a second sheet conveyance path that branches from the first sheet conveyance path at a branch portion on the first sheet conveyance path and merges with the first sheet conveyance path at a merging portion upstream, in a sheet conveying direction, of a discharge port to the sheet supporting portion, a guide unit configured to selectively guide the sheet to the first sheet conveyance path or the second sheet conveyance path in the branch portion, and a control unit configured to control the guide unit. The control unit controls the guide unit so as to guide a first sheet conveyed first in the sheet bundle to be processed by the sheet processing unit to the second sheet conveyance path and guide at least one of the sheets whose leading edge reaches the branch portion to the second sheet conveyance path among the sheets following the first sheet of the sheet bundle, when the sheet processing unit is in a non-processing state of not performing the process on a sheet bundle on the sheet supporting portion.

According to a fourth aspect of the invention, an image forming system includes an image forming unit configured to form an image on a sheet, a sheet supporting portion on which a sheet on which the image is formed by the image forming unit is discharged and supported, a sheet processing unit configured to perform processing on a sheet bundle composed of a plurality of sheets discharged on the sheet supporting portion, a first sheet conveyance path for guiding the sheet to the sheet supporting portion, a second sheet conveyance path that branches from the first sheet conveyance path at a branch portion on the first sheet conveyance path and merges with the first sheet conveyance path at a merging portion upstream, in a sheet conveying direction, of a discharge port to the sheet supporting portion, a guide unit configured to selectively guide the sheet to the first sheet conveyance path or the second sheet conveyance path in the branch portion, and a control unit configured to control the guide unit. The control unit controls the guide unit so as to guide a first sheet conveyed first in the sheet bundle to be processed by the sheet processing unit to the second sheet conveyance path, and guide a second sheet following the first sheet to the first sheet conveyance path to merge the first and second sheets in an overlapping manner at the merging portion, and guide at least one of sheets following the second sheet among a plurality of sheets constituting the sheet bundle to the second sheet conveyance path.

Further features of the present invention will become apparent from the following description of exemplary embodiments with reference to the attached drawings.

BRIEF DESCRIPTION OF THE DRAWINGS

FIG. 4A is a diagram of sheet conveyance.

FIG. 4B is a schematic diagram showing a positional relationship of sheets.

DESCRIPTION OF THE EMBODIMENTS

Exemplary embodiments for carrying out the present invention will be described in detail below with reference to drawings. However, the dimensions, materials, shapes, and relative arrangements of the components described in this embodiment should be changed as appropriate according to the configuration of an apparatus to which the invention is applied and are not intended to limit the scope of the present invention to the following embodiments. In the present embodiment, a sheet includes special paper such as coated paper, recording material having a special shape such as envelope and index paper, and a plastic film or cloth for an overhead projector, in addition to plain paper. Furthermore, a document is an example of a sheet, and the document may be a blank sheet or may have an image formed on one side or both sides.

First Embodiment

Schematic Configuration of Image Forming System

Figure 1:
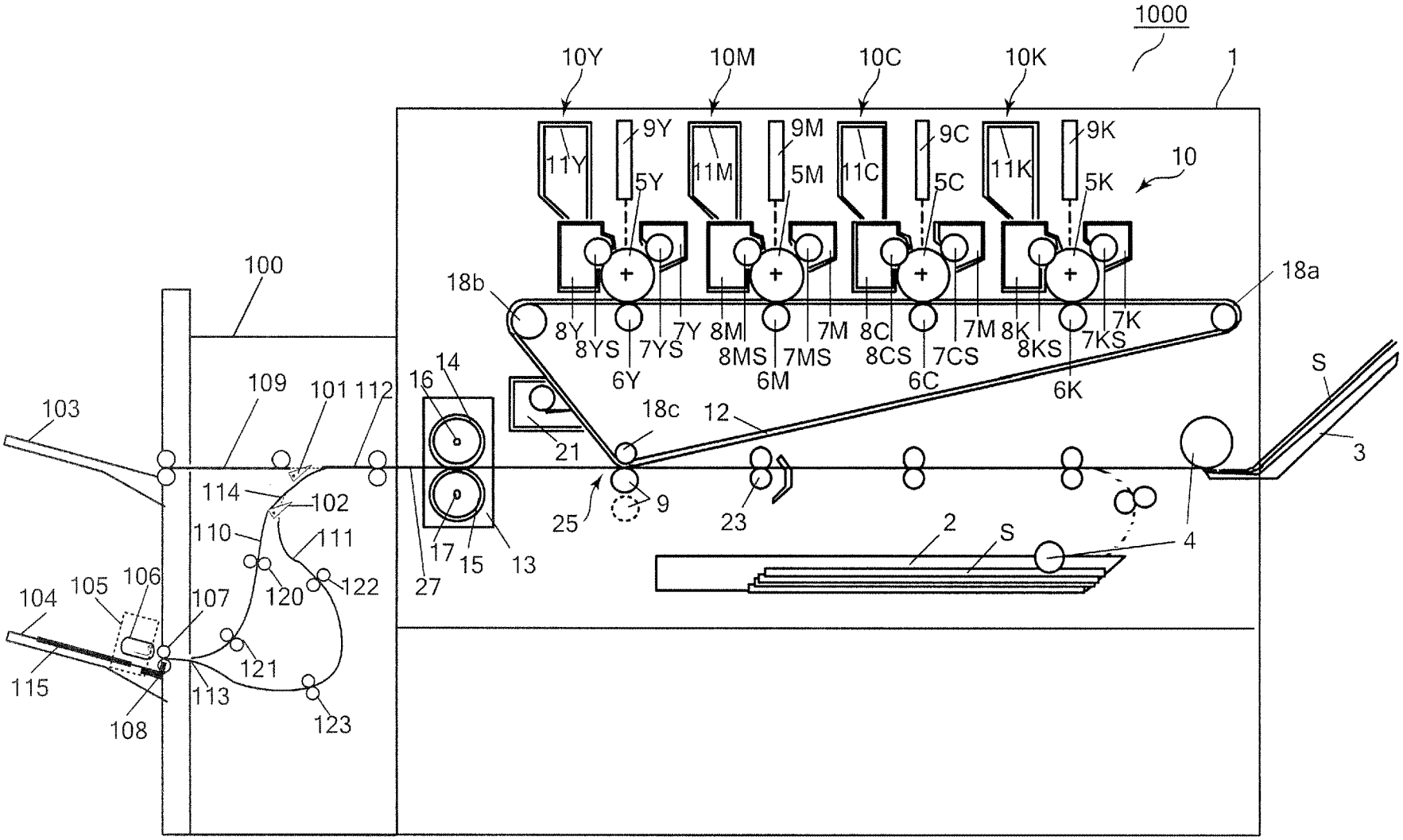
FIG. 1 is a schematic configuration diagram of an image forming system according to a first embodiment.

As shown in FIG. 1, an image forming system 1000 according to the present embodiment includes an image forming apparatus 1 that forms an image on a sheet and a sheet processing apparatus 100 as a sheet processing apparatus mounted on the image forming apparatus 1. The image forming apparatus 1 is an image forming apparatus provided with a so-called intermediate transfer tandem type image forming unit 10 including four image forming units 10Y, 10M, 10C, and 10K inside the apparatus body. The image forming apparatus 1 forms an image on a sheet S based on image information read from a document or image information input from an external device and outputs the sheet S.

The image forming units 10Y, 10M, 10C, and 10K are units of an electrophotographic system that forms yellow (Y), magenta (M), cyan (C), and black (K) toner images. Since the configuration of each image forming unit is basically the same except that the color of the contained toner is different, an image forming process will be described using the yellow image forming unit 10Y as an example.

When the image forming process is started, a photosensitive drum 5Y of the image forming unit 10Y configured by applying an organic optical conductive layer to the outer periphery of an aluminum cylinder is rotationally driven. The surface of the photosensitive drum 5Y is uniformly charged by a charge unit 7Y and then exposed by an exposing unit (for example, a laser scanner) 9Y to form an electrostatic latent image. Then, the electrostatic latent image is visualized (developed) with the toner supplied from a developing unit 11Y to form a toner image.

Similarly, in the image forming units 10M, 10C, and 10K, a corresponding color toner image is formed on the photosensitive drum. The toner images formed on the respective photosensitive drums are primarily transferred by corresponding primary transfer rollers 6Y to 6K so as to overlap each other on an intermediate transfer belt 12 that is an intermediate transfer member.

In parallel with such an image forming process, a sheet feeding unit 4 performs a feeding operation for feeding the sheet S toward the image forming unit 10. The sheet feeding unit 4 includes a sheet supporting unit such as a cassette 2 or a manual feed tray 3 that supports the sheet S and a sheet feeding unit 4 that feeds the sheet S supported by the sheet supporting unit. The sheet feeding unit 4 includes a mechanism such as a retard separation system or a separation pad system, and separates the sheets S one by one and feeds the sheet to a registration unit 23.

The registration unit 23 performs skew correction of the sheet S and conveys the sheet S toward a secondary transfer unit 25 as the image forming process in the image forming unit 10 progresses. In the secondary transfer unit 25, a secondary transfer outer roller 9 and a secondary transfer inner roller 18*c* are arranged so as to nip the intermediate transfer belt 12. The toner image carried on the intermediate transfer belt 12 is secondarily transferred to the sheet S at a secondary transfer nip between the secondary transfer outer roller 9 and the intermediate transfer belt 12. The transfer residual toner remaining on the intermediate transfer belt 12 is removed by a belt cleaning unit 21. The secondary transfer outer roller 9 is in contact with the intermediate transfer belt 12 as indicated by a solid line during the secondary transfer, but moves away to the position indicated by a dotted line when the secondary transfer is not being performed.

The sheet S to which an unfixed toner image has been transferred is transferred to a fixing unit 13 and is nipped between a pair of heating rollers 14 and 15 so as to be heated and pressed, whereby the toner is melted and fixed. The sheet S on which the image is fixed is delivered to the sheet processing apparatus 100. In the present embodiment, the sheet on which the image is fixed is directly discharged to the sheet processing apparatus 100 by the pair of heating rollers 14 and 15 of the fixing unit 13. However, a sheet discharge roller pair may be provided between the fixing unit 13 and a sheet discharge port of the image forming apparatus 1, and the sheet may be conveyed to a sheet receiving port of the sheet processing apparatus 100 by the sheet discharge roller pair.

The sheet processing apparatus 100 receives the image-formed sheets sent from the image forming apparatus through a receiving path 112, sorts the sheets into an upper discharge tray 103 and a lower discharge tray 104, and loads the sheets. When the sheets are sorted into the upper discharge tray 103 and the lower discharge tray 104, a switching flapper 101 is driven by a solenoid (not shown) to switch the conveyance path. That is, when discharging a sheet to the upper discharge tray 103, the sheet is transferred to an upper discharge conveyance path 109, and when discharging a sheet to the lower discharge tray 104, the sheet is transferred to a lower discharge conveyance path 110. A retreat conveyance path 111 is a path branched at a branch portion 114 on the lower discharge conveyance path 110, and joins the lower discharge conveyance path 110 again at a lower discharge merging point 113 just before the discharge port to the lower discharge tray 104. In the present embodiment, the merging point constitutes a merging portion that is upstream of the discharge port to the sheet supporting portion 104 in the sheet conveyance direction. The lower discharge conveyance path 110 includes a lower discharge conveyance upstream roller 120 and a lower discharge conveyance downstream roller 121, and the retreat conveyance path 111 includes a retreat conveyance upstream roller 122 and a retreat conveyance downstream roller 123, which is driven by a lower discharge motor (not shown). Switching of the conveyance path to the retreat conveyance path 111 is performed by a discharge conveyance switching flapper 102. The use of the retreat conveyance path 111 will be described later.

The lower discharge tray 104 includes a stapling unit 105, a stapling unit movement mechanism 115, and an alignment belt 106 and can perform the following post-process. When the trailing edge of the sheet conveyed to the lower discharge tray 104 passes through a sheet discharge roller 107, the alignment belt 106 is lowered so as to come into contact with the sheet by a lifting motor (not shown), and then rotated counterclockwise (in the direction of the arrow in the drawing) by a drive motor (not shown). Then, an alignment process in the carry-out direction is performed by abutting the sheet against a stopper 108. When performing stapling, a predetermined number of sheets are stacked on the lower discharge tray 104 to form a bundle, the stapling unit movement mechanism 115 moves the stapling unit 105 to a stapling position, and a stapling process is performed by the stapling unit 105. While the stapling process is being performed, the lower discharge tray 104 cannot accept subsequent sheets.

Hardware Configuration of Image Forming System

Figure 2:
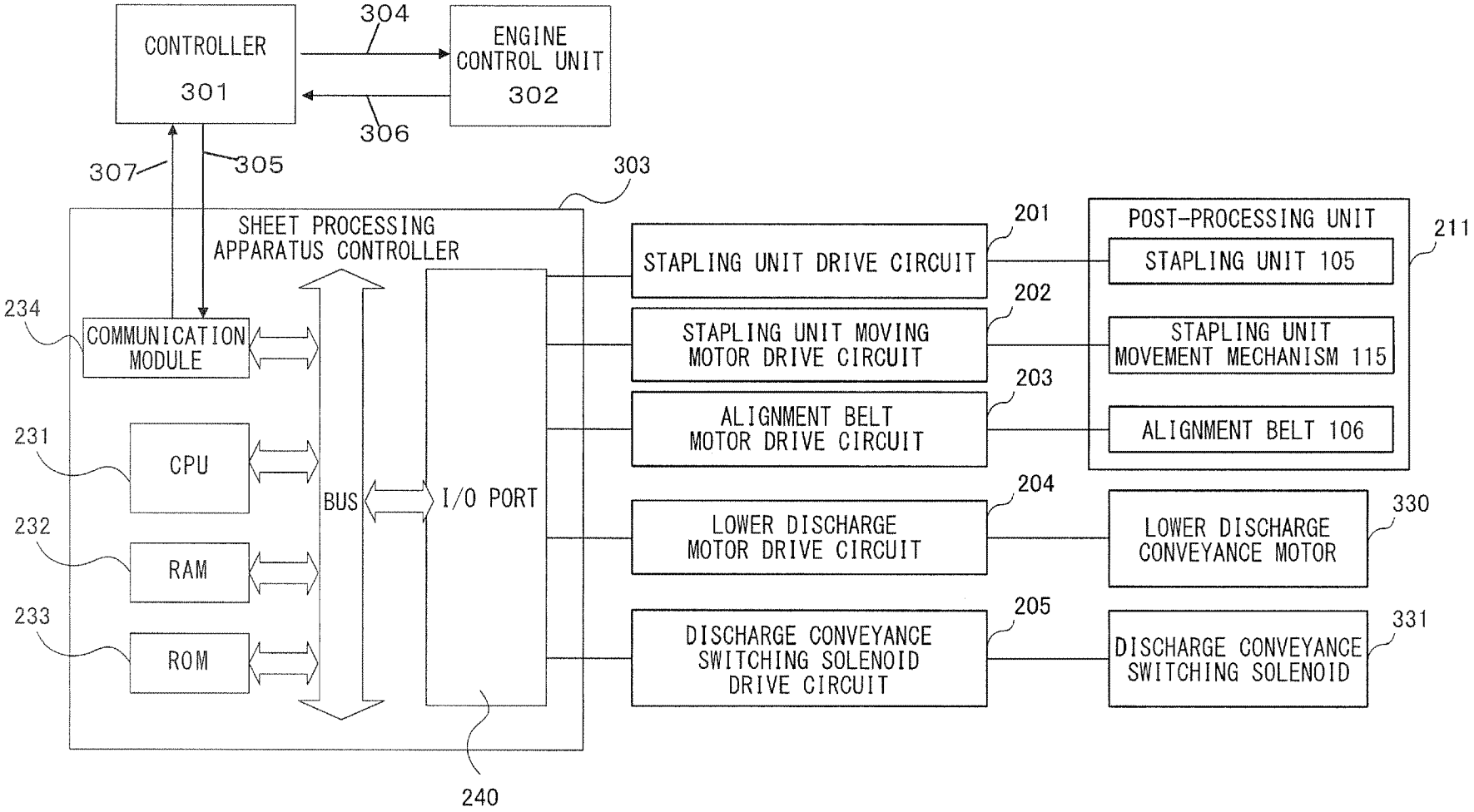
FIG. 2 is a block diagram of a hardware configuration of a sheet processing apparatus controller according to the first embodiment.

Next, a hardware configuration in the image forming system 1000 around the sheet processing apparatus 100 will be described with reference to FIG. 2. Here, the configuration related to the conveyance to the upper discharge tray 103 is omitted. 301 is a controller that controls the image forming apparatus 1 and the sheet processing apparatus 100, 302 is an engine control unit that controls the image forming apparatus 1, and 303 is a sheet processing apparatus controller that controls the sheet processing apparatus 100. Reference numeral 304 denotes a serial command transmission signal line for transmitting a command from the controller 301 to the engine control unit 302, and reference numeral 305 denotes a serial command transmission signal line for transmitting a command to the sheet processing apparatus controller 303 from the controller 301 by serial communication. Reference numeral 306 denotes a serial status transmission signal line for transmitting status data from the engine control unit 302 to the controller 301 in response to the command, and reference numeral 307 denotes a serial status transmission signal line from the sheet processing apparatus controller 303 to the controller 301 by serial communication. In performing a printing operation, the controller 301 transmits a serial command to the engine control unit 302 and the sheet processing apparatus controller 303. Control is performed by receiving status data from the engine control unit 302 and the sheet processing apparatus controller 303. In this way, in the case where a plurality of devices are connected and operate, the controller 301 centrally manages the control and status of each device and maintains the alignment of operation between the devices.

The sheet processing apparatus controller 303 is a control IC and includes a CPU 231 that controls various operations of the sheet processing apparatus, and a RAM 232 that temporarily stores control data necessary for the operations of the sheet processing apparatus. A communication module 234 that performs communication processing with the ROM 233 that store a control table necessary for the operations of a program and the sheet processing apparatus in a nonvolatile manner and the controller 301 is provided. Furthermore, an I/O port 240 that inputs and outputs control signals to and from various units in the sheet processing apparatus 100 is provided. A stapling unit drive circuit 201 and a stapling unit moving motor drive circuit 202 receive a control signal from the sheet processing apparatus controller 303 and drive the stapling unit 105 and the stapling unit movement mechanism 115 in a post-processing unit 211. Similarly, an alignment belt motor drive circuit 203, a lower discharge motor drive circuit 204, and a discharge conveyance switching solenoid drive circuit 205 receive the control signal and drive the alignment belt 106, a lower discharge conveyance motor 330, and a discharge conveyance switching solenoid 331.

Figure 3:
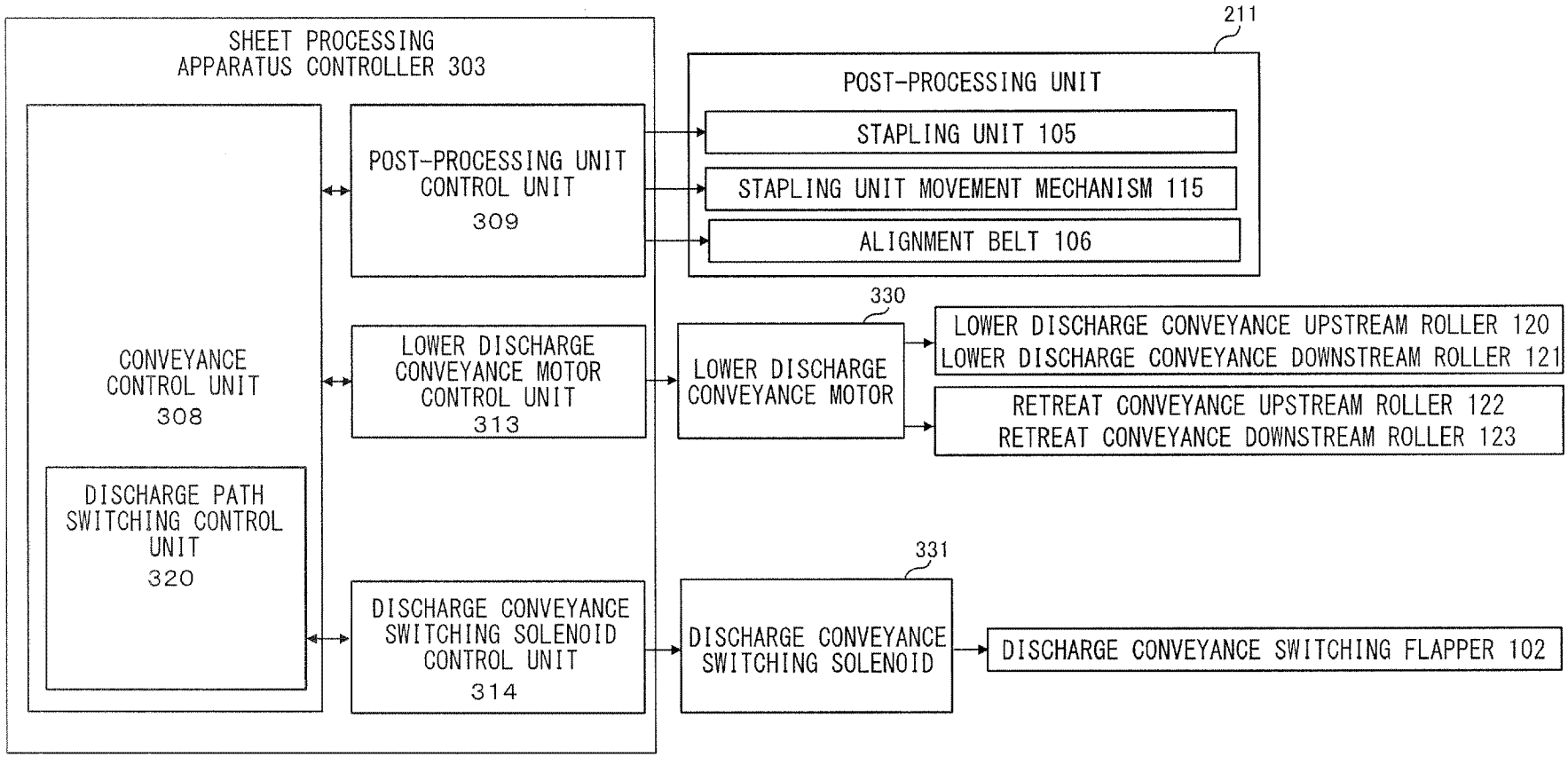
FIG. 3 is a functional block diagram of the sheet processing apparatus according to the first embodiment.

FIG. 3 is a control block diagram showing conveyance control performed by the sheet processing apparatus controller 303. Here, the configuration related to the conveyance to the upper discharge tray 103 is omitted. In FIG. 3, the sheet processing apparatus controller 303 includes a conveyance control unit 308, a post-processing unit control unit 309, a lower discharge motor control unit 313, and a discharge conveyance switching solenoid control unit 314. The conveyance control unit 308 performs a discharge conveyance operation in response to a discharge control command from the controller and instructs the post-processing unit control unit 309 to perform a post-process on the sheet and the sheet bundle discharged from the image forming apparatus. The post-processing unit control unit 309 controls the stapling unit 105, the stapling unit movement mechanism 115, and the alignment belt 106 in the post-processing unit 211. In the case where a sheet discharge destination is the lower discharge tray 104, the conveyance control unit 308 drives the lower discharge conveyance motor 330 by the lower discharge motor control unit 313 to rotate the lower discharge conveyance upstream roller 120 and the lower discharge conveyance downstream roller 121 in the lower discharge conveyance path 110. The retreat conveyance upstream roller 122 and the retreat conveyance downstream roller 123 in the retreat conveyance path 111 are rotated. In the case where the sheet discharge destination is the lower discharge tray 104, the discharge path switching control unit 320 of the conveyance control unit 308 determines whether to send the sheet to the retreat conveyance path 111 or the lower discharge conveyance path 110. Then, the discharge conveyance switching solenoid control unit 314 drives the discharge conveyance switching solenoid 331 and switches the conveyance path by the discharge conveyance switching flapper 102.

Configuration of Retreat Conveyance Path

Next, the relationship between the retreat conveyance path 111 and the productivity of the entire apparatus when the post-process is performed in the lower discharge tray 104 will be described. FIG. 4A is a diagram showing the relationship between the sheet leading edge position and time with a vertical axis as a position in the lower discharge conveyance path 110 and a horizontal axis as elapsed time. The starting point of the vertical axis is the start position of the lower discharge conveyance path 110, that is, the position branched from the receiving path 112 by the discharge destination switching flapper 101. In the case where no post-process is performed on a preceding sheet bundle, after entering the lower discharge conveyance path 110 (A in FIG. 4A), the sheet passes the position (B in FIG. 4A) of the discharge conveyance switching flapper 102, the position (C in FIG. 4A) of the lower discharge merging point 113, and the sheet discharge roller 107. Then, the discharge to the lower discharge tray 104 is completed (H in FIG. 4A). From the time when the discharge of a last sheet of a first bundle to the lower discharge tray 104 is completed, that is, the time when the trailing edge of a third sheet passes the position of the sheet discharge roller 107 (D in FIG. 4A), the stapling process is performed on a bundle of three sheets on the lower discharge tray 104. In order to obtain the maximum print productivity as a system, it is necessary for the sheet processing apparatus 100 to accept sheets sent at an interval for the maximum productivity of the image forming apparatus. On the other hand, the stapling process for the sheet bundle requires a certain time, and a succeeding sheet cannot be received in the lower discharge tray 104 during this process. Here, a first sheet S11 of a subsequent bundle is conveyed to the retreat conveyance path 111 after the conveyance path is switched by the discharge conveyance switching flapper 102 (E in FIG. 4A). The retreat conveyance path 111 has a longer path length to the lower discharge merging point 113 than the lower discharge conveyance path 110. That is, the path length of a second sheet conveyance path (111) between the branch portion 114 and the merging point 113 is longer than the path length of a first sheet conveyance path (110). For this reason, the timing at which the first sheet S11 of the subsequent bundle arrives at the lower discharge merging point 113 can be delayed (F in FIG. 4A). In this drawing, the section E-F where the sheet S11 travels the retreat conveyance path 111 is indicated by a dotted line, and reaches the lower discharge merging point 113 almost overlapping with a subsequent sheet S12 conveyed to the lower discharge conveyance path 110. FIG. 4B shows the positional relationship of the sheets in the conveyance path at the timing when the leading edge of the second sheet S12 and the leading edge of the first sheet S11 reach the lower discharge merging point 113 to merge.

As described above, when the post-process is performed in the lower discharge tray 104, the sheet processing apparatus 100 can always accept sheets from the image forming apparatus 1 at regular intervals by detouring around the first sheet of the subsequent bundle to the retreat conveyance path 111. The sheet S11 that has been detoured to the retreat conveyance path 111 and the subsequent sheet S12 that has been conveyed to the lower discharge conveyance path 110 need to be merged so as to overlap at the lower discharge merging point 113 for the alignment process described later.

For this purpose, the path length of the retreat conveyance path 111 needs to be longer than the path length of the lower discharge conveyance path 110, or the conveying speed of the sheet S11 in the retreat conveyance path needs to be slower than the conveying speed of the sheet S12 in the lower discharge conveyance path 110. In the present embodiment, the lower discharge conveyance upstream roller 120 and the lower discharge conveyance downstream roller 121, and the retreat conveyance upstream roller 122 and the retreat conveyance downstream roller 123 are driven at a fixed speed by the same lower discharge conveyance motor 330 (see FIG. 2). The speed is the same as the conveying speed of the upstream receiving path 112. Therefore, the path length of the retreat conveyance path 111 is designed such that the leading edge of the first sheet S11 reaches the lower discharge merging point 113 to merge at the timing when the leading edge of the second sheet S12 of a second bundle that has been conveyed on the lower discharge conveyance path 110 reaches the lower discharge merging point 113. Therefore, the merged first sheet S11 and second sheet S12 are discharged to the lower discharge tray 104 in a substantially overlapping state.

A time T_DG until the leading edge of the first sheet (first sheet S1) of a next bundle reaches the sheet discharge roller 107 after the trailing edge of the last sheet of the bundle passes through the sheet discharge roller 107 is a time determined by the productivity of the image forming apparatus. At the maximum throughput of the image forming apparatus, in order to achieve maximum productivity as a system without a loss time due to the sheet processing apparatus 100, a time T_process required for the bundle alignment process and the stapling process needs to be designed to be shorter than the value of T_DG at the maximum throughput of the image forming apparatus. In the case where the T_process is longer than this, it is necessary to reduce the productivity of the image forming apparatus and increase the interval between the bundles.

As can be seen from FIG. 4A, among the sheets to be discharged to the lower discharge tray 104, only the first sheet of the bundle to be post-processed passes through the retreat conveyance path 111. That is, the greater the number of sheets per bundle when performing the post-process and the greater the number of bundles (number of bundles) to be post-processed, as described above, the greater the number of sheets to be passed is biased toward the lower discharge conveyance path 110. Usually, in such a sheet processing apparatus, a large amount of sheets are passed beyond the usage period of the apparatus, and therefore the characteristics of the sheet conveying performance may change due to the influence of the wear of the conveyance rollers and accumulation of paper dust in the paths. As in this example, in a configuration where sheets that have passed through different conveyance paths are merged and overlapped, if the paper passing amount is biased to one of the paths, there is a possibility that the degree of influence on the conveyance performance due to the wear of the rollers and accumulation of paper dust is greater than that of the other path. In that case, the following problem may occur in the alignment process.

Example of Problems in Alignment Process Due to Bias in Paper Passing Amount

Figure 5A:
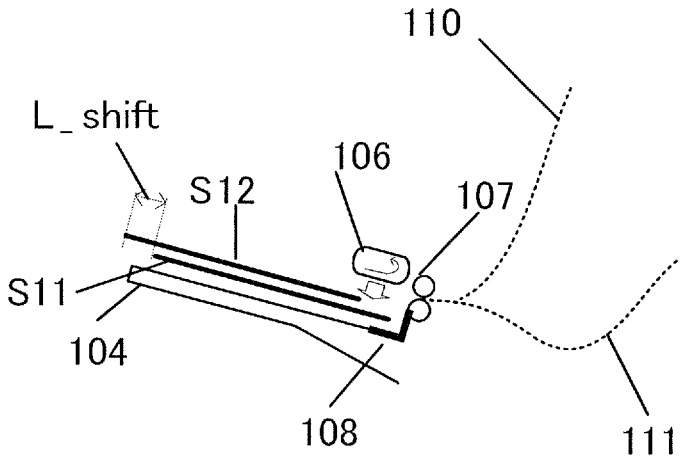
FIG. 5A is a schematic diagram showing an alignment process in the sheet processing apparatus.
Figure 5B:
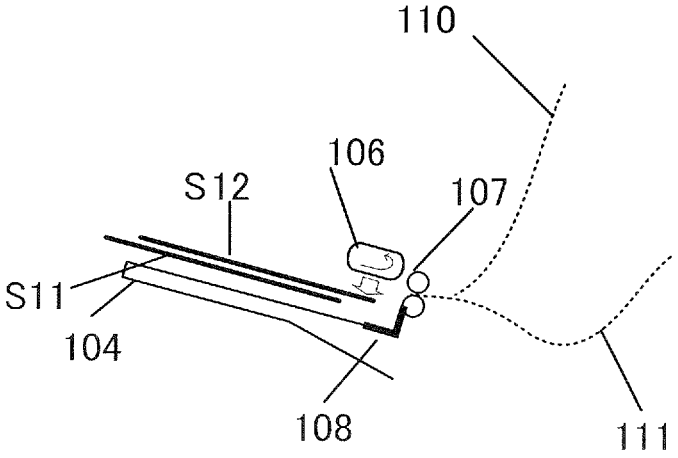
FIG. 5B is a schematic diagram showing a case where the alignment process for a first sheet is not performed.

Here, with reference to FIG. 5, an alignment process for the two sheets that have merged at the lower discharge merging point 113 and conveyed to the lower discharge tray 104 will be described. For these two overlapped sheets that are discharged, the trailing edge of the first sheet S11 of the bundle is pulled back to the alignment belt 106 before the trailing edge of the second sheet S12 of the bundle and abuts against the stopper 108. Thereafter, the second sheet S12 of the bundle slides on the first sheet S11 of the bundle and is aligned by the stopper 108 in the same manner. For this purpose, as shown in FIG. 5A, the second sheet S12 that overlaps the upper side needs to be discharged to the lower discharge tray 104 in a state of being advanced from the first sheet S11 that is on the lower side. Here, in the case where the transfer performance changes greatly only in one path, a deviation L_shift between the leading edges of the sheet S12 conveyed through the lower discharge conveyance path 110 and the sheet S11 conveyed through the retreat conveyance path 111 may not be as designed, and a desired alignment process may not be performed. In particular, when only the conveyance performance of the lower discharge conveyance path 110 is degraded, the conveyance of the sheet S12 is delayed, and as shown in FIG. 5B, the second sheet S12 of the bundle that overlaps the upper side is discharged to the lower discharge tray 104 in a state of being delayed from the first sheet S11 of the bundle that is the lower one, the alignment process for the sheet S11 on the lower side is not performed.

Path Switching Control

As described above, the present embodiment is configured such that path switching control is executed so that the sheet passing amount is not extremely biased between the discharge conveyance path 110 and the retreat conveyance path 111. That is, in the present embodiment, the path is switched so that the occurrence of a loss time by the sheet processing apparatus 100 is avoided, the amount of paper passing through both paths is dispersed, and the degree of influence on conveyance performance due to the wear of the rollers and accumulation of paper dust does not increase only in one path.

Figure 6A:
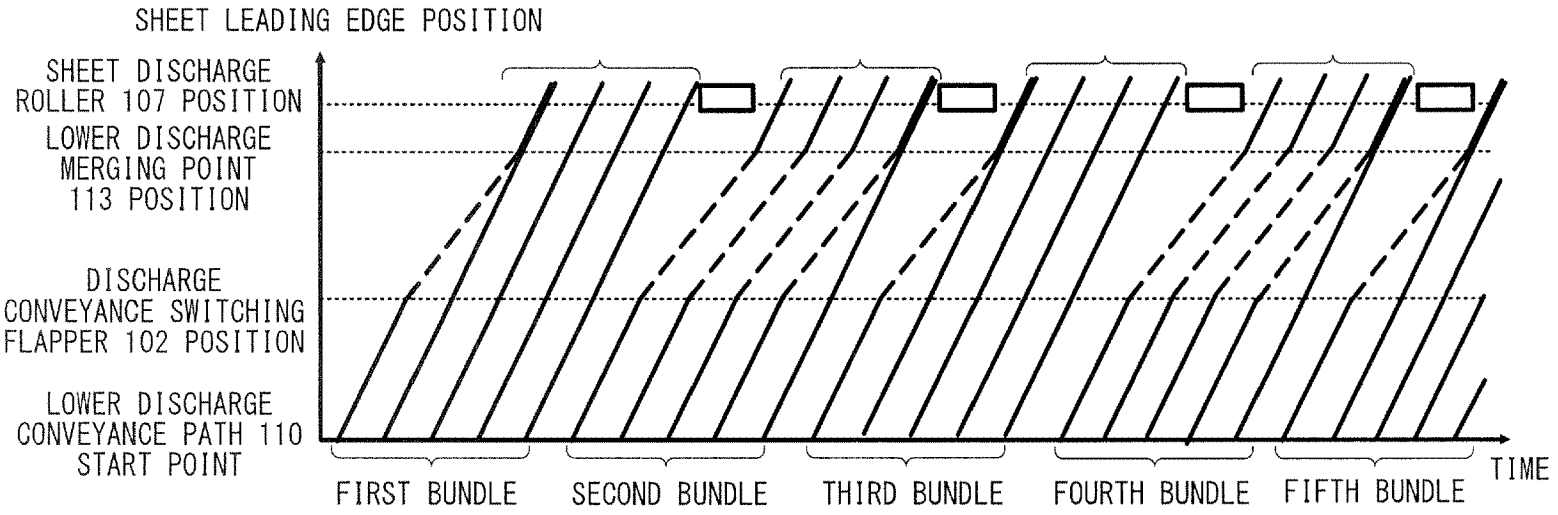
FIG. 6A is a diagram of sheet conveyance in the sheet processing apparatus according to the first embodiment.

FIG. 6A is a diagram showing the relationship between the sheet leading edge position and time when the sheet is conveyed through the lower discharge conveyance path by the path switching control according to the present embodiment, which shows an example in which the stapling process for every five sheets is performed for a plurality of units. The description of the sheet leading edge position on the vertical axis and the description of the retreat conveyance path indicated by the dotted line are the same as in FIG. 4A. That is, the section in which the sheet S11 travels in the retreat conveyance path 111 from the position of the discharge conveyance switching flapper 102 to the position of the lower discharge merging point 113 is indicated by a dotted line, and when traveling in the lower discharge conveyance path 110, the section is indicated by a solid line.

As shown in FIG. 6A, the last sheet of each bundle is discharged to the lower discharge tray 104 through the lower discharge conveyance path 110, and the first sheet of the subsequent bundle passes through the retreat conveyance path 111 while the post-process of the sheet bundle is performed on the lower discharge tray 104. In addition, the conveyance path is switched so that bundles (first bundle, third bundle, and fifth bundle) in which the number of sheets passing through the lower discharge conveyance path 110 increases and bundles (second bundle and fourth bundle) in which the number of sheets passing through the retreat conveyance path 111 increases is alternately repeated. For the sheets sent from the image forming apparatus to the lower discharge conveyance path 110 at regular intervals, the post-process is performed while maintaining productivity, and it can be seen that the number of sheets passing through the lower discharge conveyance path 110 and the retreat conveyance path 111 is substantially the same.

Figure 7:
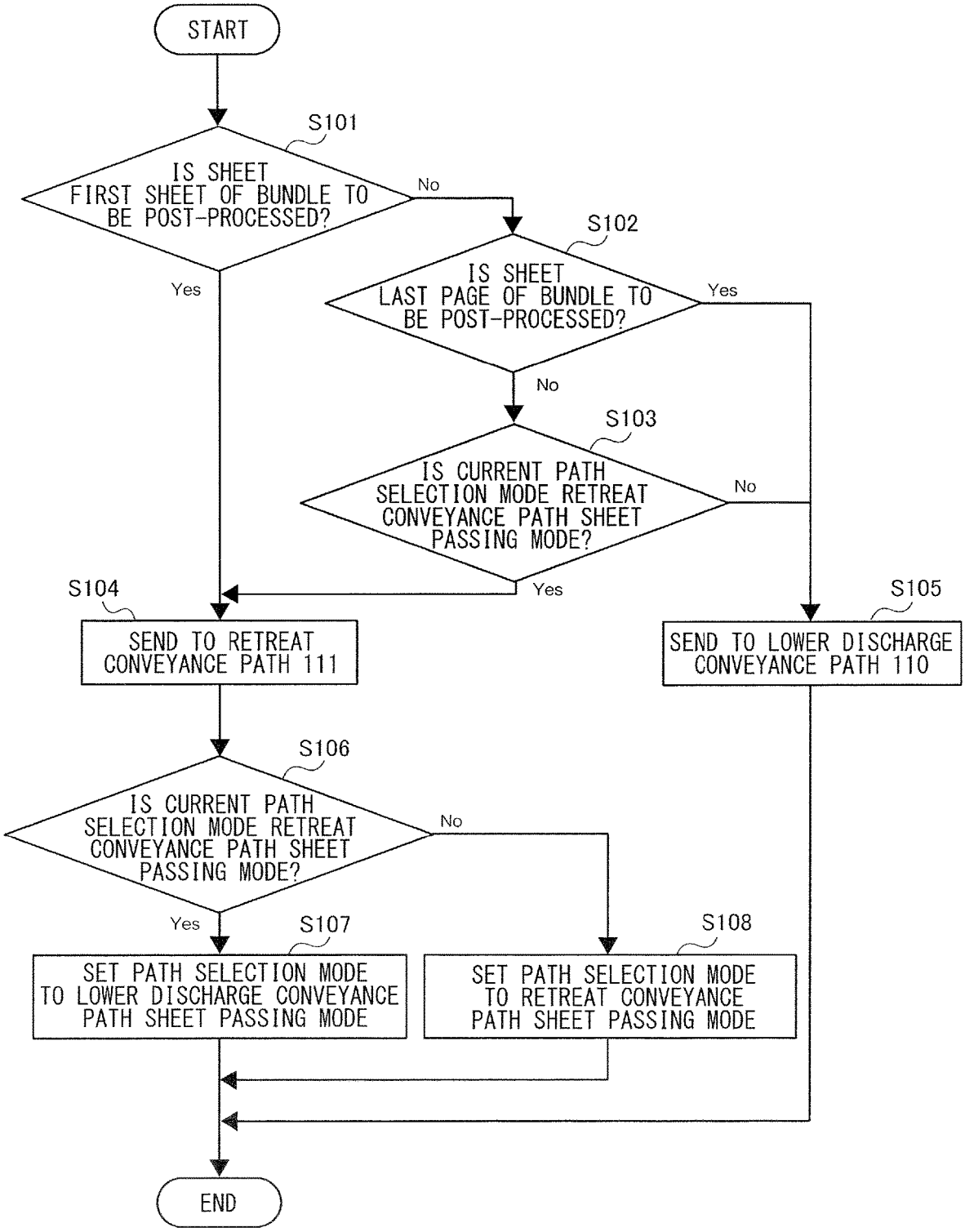
FIG. 7 is a control flowchart in the sheet processing apparatus according to the first embodiment of the present invention.

FIG. 7 is a flowchart of path switching control performed by the discharge path switching control unit 320 when the sheet S1 is discharged to the lower discharge tray 104 for realizing the present invention. In this flowchart, description will be made on the assumption that the sheet S1 is the second and subsequent sheets of a job, but in carrying out the present invention, there is no problem even if the description is applied to the first bundle of the job in order to simplify a control program.

In step S101, it is determined whether the sheet S1 is the first sheet of a bundle to be post-processed on the lower discharge tray 104. In the case of the first sheet of the bundle, the post-process is being performed on a preceding bundle, and therefore the next sheet cannot be received on the lower discharge tray 104. Therefore, the sheet S1 is sent to the retreat conveyance path 111 in step S104.

Here, the discharge path switching control unit 320 stores a path selection mode, which is an internal control state, in the RAM 232, and the two states of a retreat conveyance path sheet passing mode and a lower discharge conveyance path sheet passing mode are alternately switched for each bundle to be post-processed. That is, in step S106, in the case where a current path selection mode is the retreat conveyance path sheet passing mode, the pass selection mode is switched to the lower discharge conveyance path sheet passing mode (step S107). On the other hand, in the case where the current path selection mode is not the retreat conveyance path sheet passing mode, the path selection mode is switched to the retreat conveyance path sheet passing mode (step S108). In the path switching control for the second and subsequent sheets of the bundle, the path selection mode stored here is applied.

In the case of No in step S101, that is, in the case where the sheet S1 is not the first sheet of the bundle to be post-processed on the lower discharge tray 104, in step S102, it is determined whether the sheet S1 is the last page of the bundle to be post-processed on the lower discharge tray 104. In the case where the sheet S1 is the last sheet of the bundle to be post-processed (Yes in S102), the sheet is sent to the lower discharge conveyance path 110 in S105. That is, the last sheet of the plurality of sheets constituting the sheet bundle is guided to the lower discharge conveyance path 110 as the first sheet conveyance path. If the sheet S1 is not the first sheet of the bundle to be post-processed and is not the last page of the bundle to be post-processed (No in S102), the conveyance destination of the sheet S1 is switched in accordance with the current path selection mode in step S103. In other words, if the current path selection mode is the lower discharge conveyance path sheet passing mode (No in S103), the sheet S1 is sent to the lower discharge conveyance path 110 in step S105. On the other hand, in the case where the current path selection mode is the retreat conveyance path sheet passing mode (Yes in S103), the sheet S1 is sent to the retreat conveyance path 111 in S104.

As described above, according to the present embodiment, it is possible to maintain the productivity of the system in the configuration in which sheets that have passed through different conveyance paths are merged and overlapped. In addition, it is possible to switch the conveyance path so that the sheet passing amount of both paths is dispersed, and to prevent the degree of influence on the conveyance performance due to the wear of the rollers and accumulation of paper dust from being biased to one of the paths. As a result, even when the cumulative amount of sheets passing through the post-processing tray increases, the positional relationship of the overlapped sheets is maintained as designed, and the post-process such as alignment is correctly performed.

In the present embodiment, the lower discharge tray 104 can be said to be a sheet support portion that supports discharged sheets, and the post-processing unit 211 can be said to be a sheet processing unit that performs processing on a sheet bundle composed of a plurality of sheets discharged onto the sheet supporting portion. Further, the lower discharge conveyance path 110 can be said to be the first sheet conveyance path for conveying a sheet to the sheet supporting portion. The retreat conveyance path 111 can be said to be the second sheet conveyance path that branches from the first sheet conveyance path at the branch portion on the first sheet conveyance path and merges with the first sheet conveyance path at the merging portion upstream of the sheet conveyance direction from the discharge port to the sheet supporting portion. Further, the discharge conveyance switching flapper 102 can be said to be a guide unit that selectively guides the sheet to the first sheet conveyance path or the second sheet conveyance path at the branch portion, and the sheet processing apparatus controller 303 can be said to be a control unit that controls the guide unit. In addition, in the present embodiment, the lower discharge conveyance path sheet passing mode can be said to be a first mode that controls the guide unit such that the number of sheets (positive integer) discharged to the sheet supporting portion via the first sheet conveyance path is larger than the number of sheets (non-negative integer) discharged to the sheet supporting portion via the second sheet conveyance path. Furthermore, the retreat conveyance path sheet passing mode can be said to be a second mode that controls the guide unit such that the number of sheets (positive integer) discharged to the sheet supporting portion via the second sheet conveyance path among the plurality of sheets constituting the sheet bundle is larger than the number of sheets (non-negative integer) discharged to the sheet supporting portion via the first sheet conveyance path. The control unit is configured to switch between the first mode and the second mode in units of the sheet bundle in the case where the sheet processing unit continuously processes a plurality of sheet bundles. More specifically, the first mode and the second mode are switched alternately for each sheet bundle. Therefore, out of the total number of sheet bundles to be processed in the input sheet processing job, mode switching is executed so that the number of sheet bundles to be processed in the first mode and the number of sheet bundles to be processed in the second mode are substantially equal (for example, the difference between the number of sheet bundles to be processed in the first mode and the number of sheet bundles to be processed in the second mode is 1 or less.).

Thus, in the second mode, after the processing by the sheet processing unit for the preceding sheet bundle discharged onto the sheet supporting portion immediately before the sheet bundle is completed, among the sheet bundles, at least one of the sheets whose leading edges reach the branch portion is conveyed to the retreat conveyance path 111. That is, in the second mode, the control unit causes the guide unit to guide at least a part of the sheets to the second sheet conveyance path when the sheet processing unit is not processing the sheet bundle on the sheet supporting portion. For this reason, in the non-processing state, among the sheets following the first sheet of the sheet bundle, at least one of the sheets whose leading edge reaches the branch portion is guided to the second sheet conveyance path. Thereby, the sheets can be distributed and conveyed between the first sheet conveyance path and the second sheet conveyance path, and out of the total number of sheets conveyed during the input sheet processing job, the size relationship between the number of sheets to be sent to the first sheet conveyance path and the number of sheets to be sent to the second sheet conveyance path can be balanced.

In the above-described embodiment, the lower discharge tray 104, which serves as both the intermediate processing tray that temporarily supports the sheet as the sheet supporting portion to process the sheet and the discharge tray from which the final product is discharged, is illustrated. However, the intermediate processing tray and the discharge tray may be provided separately, and the intermediate processing tray may be used as the sheet supporting portion. An example of the post-processing unit 211 provided with the stapling unit 105 as a sheet processing unit, but the sheet processing unit may be configured to include a punch unit that punches holes in the sheet, for example.

In addition, in the present embodiment, the example in which the discharge path switching control unit 320 switches the path selection mode alternately for each bundle has been described. In a job received by the sheet processing apparatus controller 303, in the case where the total number (number of copies) of bundles to be post-processed is known in advance, the discharge path switching control unit 320 may perform scheduling so as to switch the path selection mode for each of a plurality of copies so that the number of copies in each mode is half of the total number of copies. That is, as in the case of switching the path selection mode alternately for each sheet bundle conveyed, the discharge path switching control unit 320 may perform scheduling so as to switch the path selection mode for a plurality of copies so that the difference between the number of sheet bundles to be processed in the first mode and the number of sheet bundles to be processed in the second mode is 1 or less. For example, in the case where it is known that the total number of copies is 10 copies, an embodiment in which the first five copies are conveyed in the lower discharge conveyance path sheet passing mode and the latter five copies are conveyed in the retreat conveyance path sheet passing mode is also possible.

Second Embodiment

Next, a second embodiment according to the present invention will be described. In the first embodiment described above, the method for managing the distribution of the sheet passing amount between the lower discharge conveyance path 110 and the retreat conveyance path 111 with a bundle to be post-processed as one unit has been described. On the other hand, the present embodiment is different in that the path switching control is executed so as to distribute the distribution of the sheet passing amount to both paths in one bundle to be post-processed. In the following description, only points different from the first embodiment will be described, and other points will be denoted by the same reference numerals as those in the first embodiment, and description thereof will be omitted.

Figure 6B:
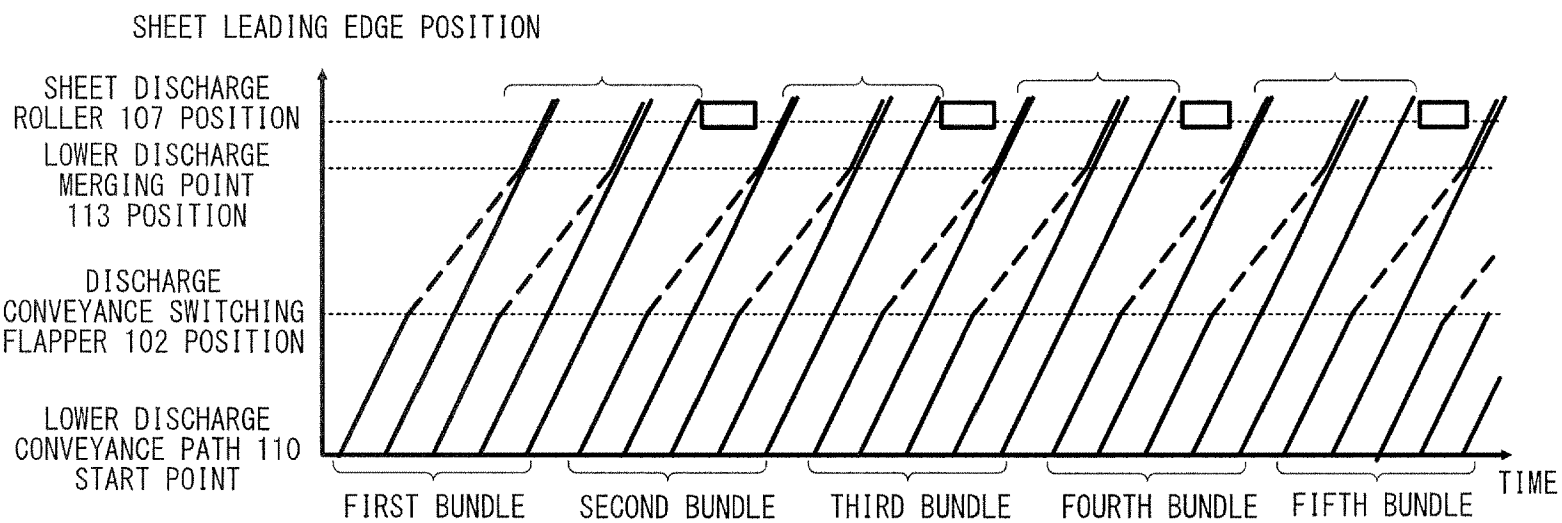
FIG. 6B is a diagram of sheet conveyance in a sheet processing apparatus according to a second embodiment.

FIG. 6B is a diagram showing the relationship between the sheet leading edge position and time when the sheet is conveyed through the lower discharge conveyance path by the path switching control according to the present embodiment, and as in the first embodiment, the stapling process is performed every five sheets for a plurality of copies. As shown in FIG. 6B, the last sheet of each bundle is discharged to the lower discharge tray 104 through the lower discharge conveyance path 110, and the first sheet of the subsequent bundle passes through the retreat conveyance path 111 while the post-process of the sheet bundle is performed on the lower discharge tray 104. In addition, in the bundle to be post-processed, the conveyance path is switched so that the sheet passing through the lower discharge conveyance path 110 and the sheet passing through the retreat conveyance path 111 are alternated. For sheets to be sent from the image forming apparatus to the lower discharge conveyance path 110 at regular intervals, it can be seen that the sheet processing apparatus performs the post-process without causing a loss time, and the number of sheets passing through the lower discharge conveyance path 110 and the retreat conveyance path 111 is substantially the same.

Figure 8:
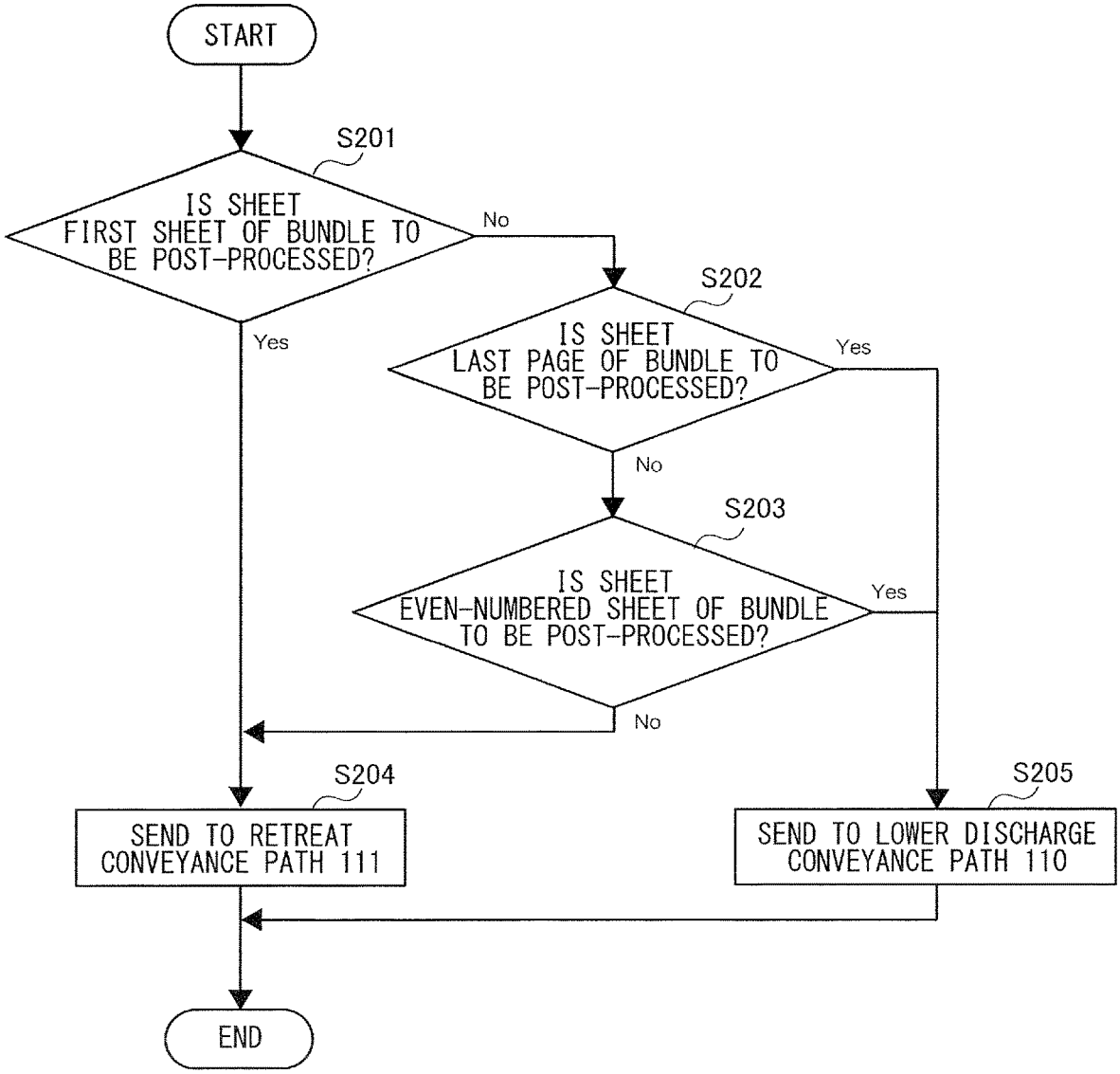
FIG. 8 is a control flowchart in the sheet processing apparatus according to the second embodiment of the present invention.

FIG. 8 is a flowchart of the path switching control in the present embodiment that is performed by the discharge path switching control unit 320 when the sheet is discharged to the lower discharge tray 104. As in the first embodiment, in this flowchart, description will be made on the assumption that the sheet is the second and subsequent sheets of a job, but in carrying out the present invention, there is no problem even if the description is applied to the first bundle of the job in order to simplify a control program.

In step S201, it is determined whether the sheet is the first sheet of a bundle to be post-processed on the lower discharge tray 104. In the case of the first sheet of the bundle, the post-process is being performed on a preceding bundle, and therefore the next sheet cannot be received on the lower discharge tray 104. Therefore, the sheet S1 is sent to the retreat conveyance path 111 in step S204. In the case of No in step S201, that is, in the case where the sheet S1 is not the first sheet of the bundle to be post-processed on the lower discharge tray 104, in S202, it is determined whether the sheet is the last sheet of the bundle to be post-processed. In the case where the sheet is the last sheet of the bundle to be post-processed (Yes in S202), the sheet is sent to the lower discharge conveyance path 110 in S205. In the case where the sheet is not the last sheet of the bundle to be post-processed (No in S202), it is determined in step S203 whether the sheet S1 is an even-numbered sheet of the bundle to be post-processed. In the case where the sheet S1 is the even-numbered sheet of the bundle (Yes in S203), the sheet S1 is sent to the lower discharge conveyance path 110 in S205. On the other hand, in the case where the sheet S1 is an odd-numbered sheet of the bundle (No in S203), the sheet S1 is sent to the retreat conveyance path 111 in S204.

Thus, in the present embodiment, it can be said that the control unit (303) controls the guide unit so as to guide the first sheet (S1) to be conveyed first in the sheet bundle to be processed by the sheet processing unit to the second sheet conveyance path and guide the second sheet (S2) following the first sheet to the first sheet conveyance path to merge these first and second sheets in an overlapping manner at the merging portion. The control unit guides at least one sheet following the second sheet among the plurality of sheets constituting the sheet bundle to the second sheet conveyance path. More specifically, the control unit controls the guide unit so as to guide the sheets following the second sheet among the plurality of sheets constituting the sheet bundle alternatively to the first sheet conveyance path and the second sheet conveyance path in units of the number of sheets. Then, by guiding at least one of the sheets following the second sheet to the second sheet conveyance path, the sheet is conveyed to the second sheet conveyance path in the sheet dischargeable period in which the post-process for the preceding sheet bundle is completed. That is, when a leading edge of the sheet guided to the second sheet conveyance path reaches the branch portion, the sheet processing unit is in a non-processing state of not performing the process on the sheet bundle on the sheet supporting portion among the sheets following the second sheet. Thereby, the sheets can be distributed and conveyed between the first sheet conveyance path and the second sheet conveyance path, and out of the total number of sheets conveyed during the input sheet processing job, the size relationship between the number of sheets to be sent to the first sheet conveyance path and the number of sheets to be sent to the second sheet conveyance path can be balanced. In the present embodiment, the unit number is set to 1, but the number is not limited thereto, and any number such as 2 or 3 may be set.

Third Embodiment

Next, a third embodiment according to the present invention will be described. In the first embodiment described above, the rollers 120 and 121 in the lower discharge conveyance path 110 and the rollers 122 and 123 in the retreat conveyance path 111 are driven by the lower discharge conveyance motor 330 in conjunction with each other. For this reason, the conveying speed of the sheet conveyed in the lower discharge conveyance path 110 and the retreat conveyance path 111 cannot be set individually. The present embodiment is different from the first embodiment described above in that the conveying speed of the sheet conveyed in the conveyance paths 110 and 111 can be set independently. In the following description, only points different from the first embodiment will be described, and other points will be denoted by the same reference numerals as those in the first embodiment, and description thereof will be omitted.

Figure 9:
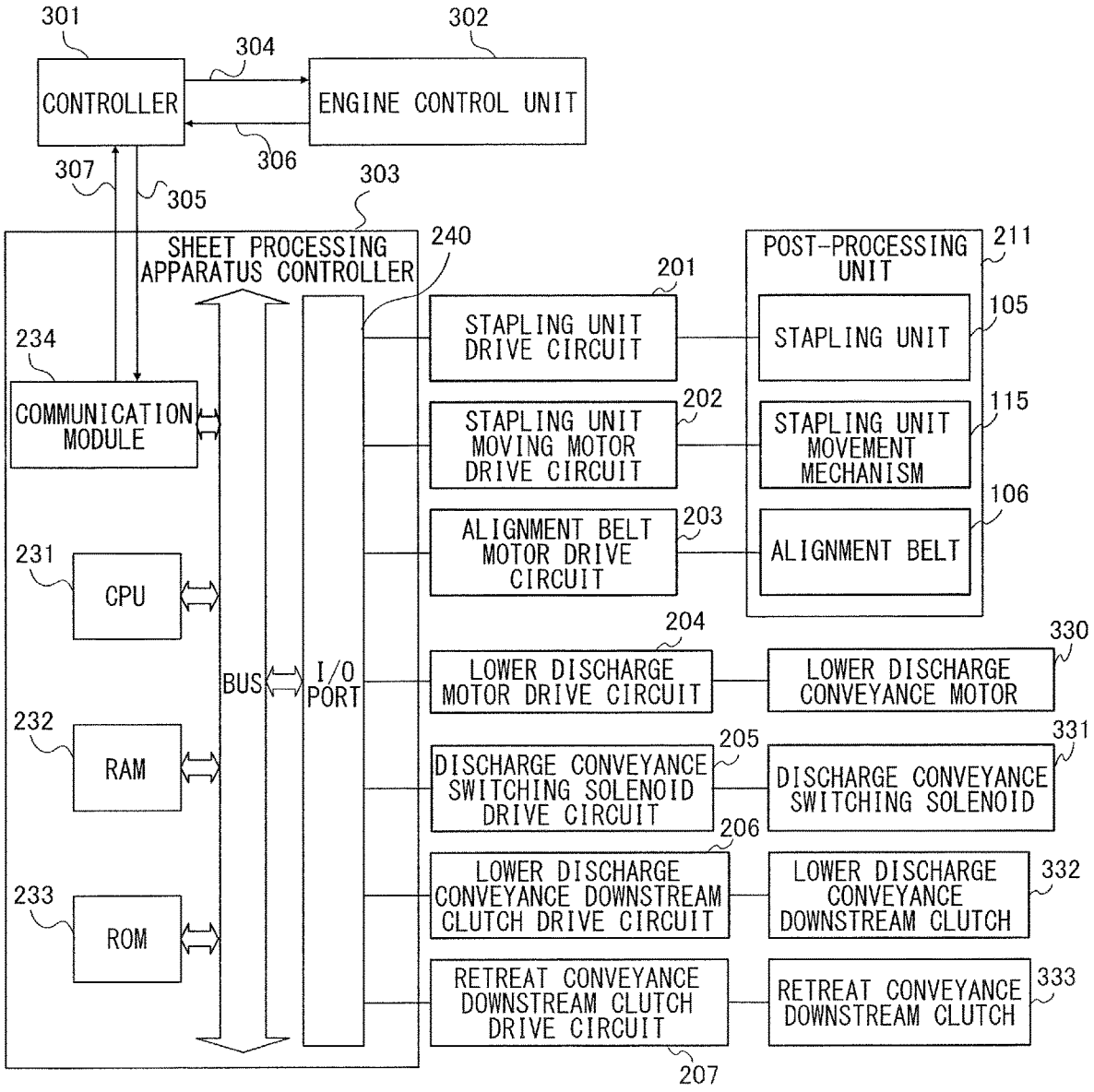
FIG. 9 is a block diagram of a hardware configuration of a sheet processing apparatus controller according to a third embodiment.
Figure 10:
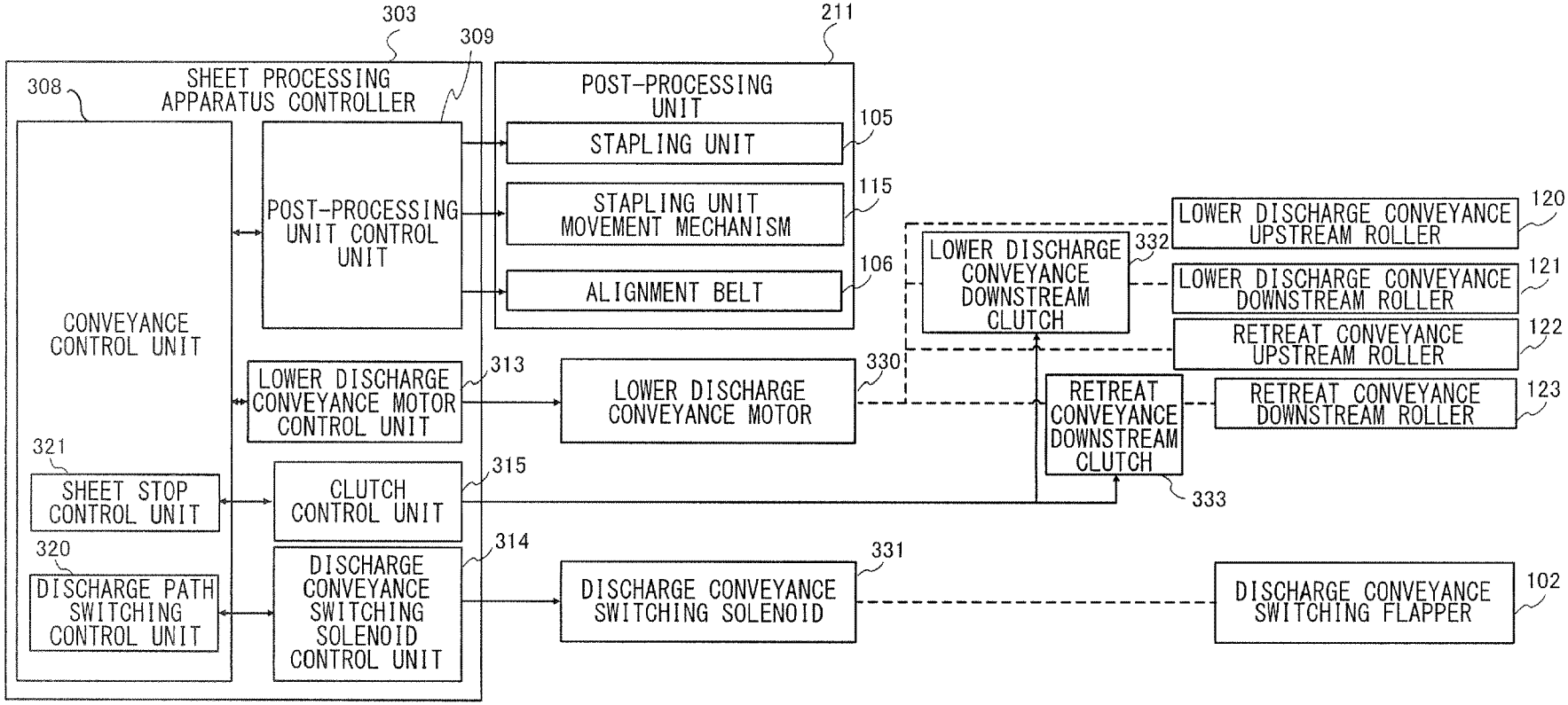
FIG. 10 is a functional block diagram of the sheet processing apparatus according to the third embodiment.

FIG. 9 is a diagram showing a hardware configuration in the image forming system 1000 around the sheet processing apparatus 100 according to the present embodiment. FIG. 10 is a control block diagram showing conveyance control performed by the sheet processing apparatus controller 303 according to the present embodiment. As shown in FIGS. 9 and 10, in the present embodiment, a lower discharge conveyance downstream clutch 332 is disposed on a power transmission path between the lower discharge conveyance motor 330 and the lower discharge conveyance downstream roller 121. A retreat conveyance downstream clutch 333 is disposed on a power transmission path between the lower discharge conveyance motor 330 and the retreat conveyance downstream roller 123.

The lower discharge conveyance downstream clutch 332 is configured to be driven by a lower discharge conveyance downstream clutch drive circuit 206 and rotates and stops the lower discharge conveyance downstream roller 121. The retreat conveyance downstream clutch 333 is configured to be driven by a retreat conveyance downstream clutch drive circuit 207 and rotates and stops the retreat conveyance downstream roller 123. A sheet stop control unit 321 of the conveyance control unit 308 determines whether to stop the sheet in the lower discharge conveyance path 110 and the retreat conveyance path 111 or to cancel the stop of the stopped sheet. The sheet stop control unit 321 uses a clutch control unit 315 to rotate and stop the lower discharge conveyance downstream roller 121 by the lower discharge conveyance downstream clutch 332 based on a determination result described later. The retreat conveyance downstream roller 123 is rotated and stopped by the retreat conveyance downstream clutch 333.

Discharge Conveyance Control

Next, sheet discharge conveyance control using the lower discharge conveyance downstream clutch 332 and the retreat conveyance downstream clutch 333 will be described with reference to FIGS. 11 and 12. In the following description, the conveyance control of the sheet of the second bundle will be described on the assumption that the preceding sheet of the bundle is discharged from the lower discharge tray 104. Further, in the following description, an example in which the stapling process is performed with three sheets as one bundle is shown.

Figure 11:
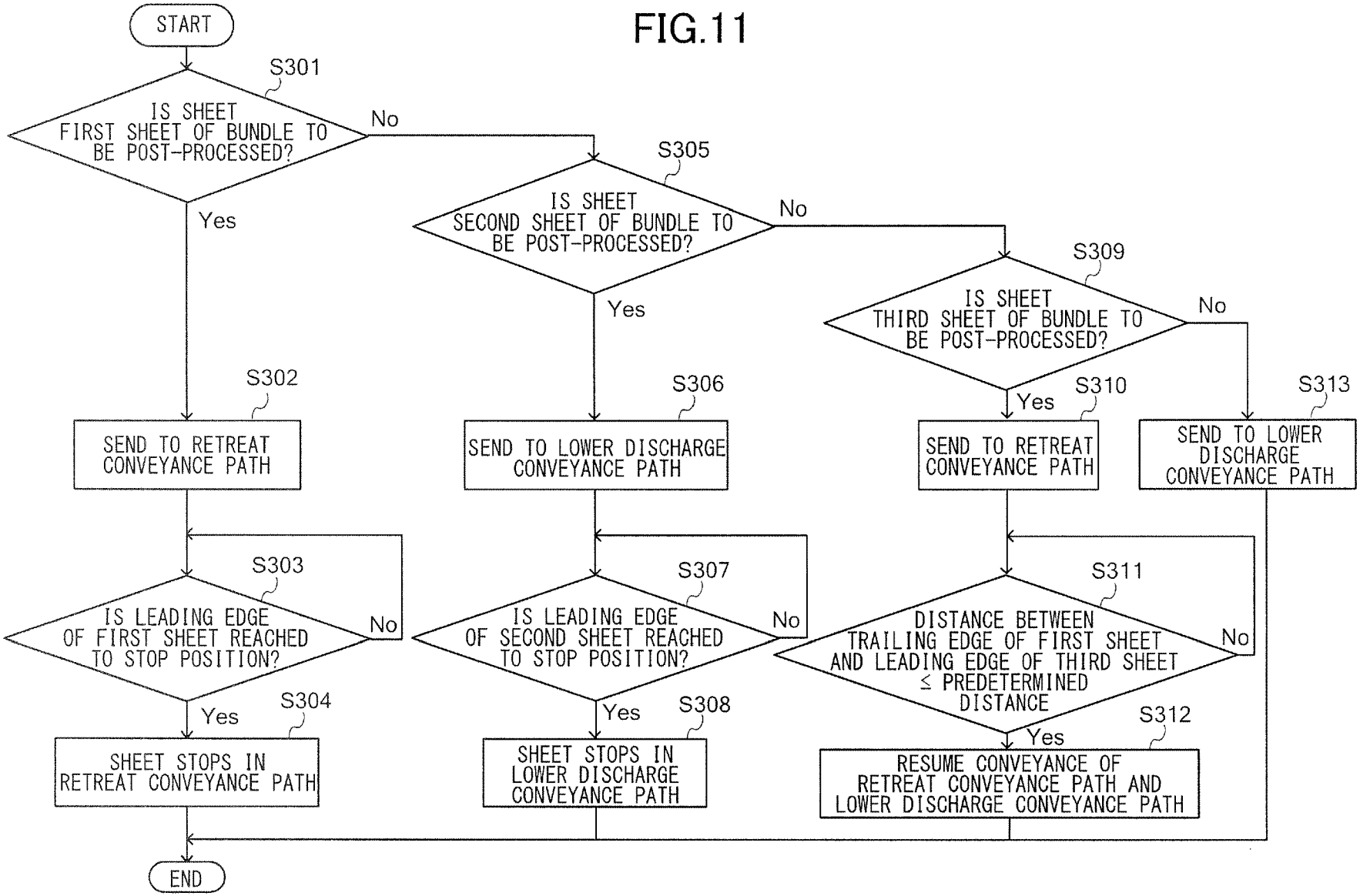
FIG. 11 is a control flowchart of sheet conveyance according to a third embodiment.

FIG. 11 is a flowchart for controlling switching of the lower discharge conveyance path 110 and the retreat conveyance path 111 by the conveyance control unit 308 in the conveyance of the sheets of the second bundle and stopping and resuming conveyance of the sheets in the two conveyance paths described above. First, conveyance control of the first sheet S1 of the bundle will be described. In step S301, the conveyance control unit 308 determines whether the sheet is a first sheet of a bundle to be post-processed on the lower discharge tray 104. If it is determined that the sheet is the first sheet of the bundle, in step S302, the discharge path switching control unit 320 switches the discharge conveyance switching flapper 102 to send the sheet S1 to the retreat conveyance path 111. In step S303, when the conveyance control unit 308 determines that the sheet S1 has reached the retreat conveyance downstream roller 123, in step S304, the retreat conveyance downstream clutch 333 is operated by the sheet stop control unit 321. Then, the retreat conveyance downstream roller 123 is stopped, and the sheet S1 is stopped in the retreat conveyance path 111.

Next, conveyance control of the second sheet S2 in the bundle will be described. In step S301, the conveyance control unit 308 determines that the sheet is not the first sheet of the bundle, and in step S305, the conveyance control unit 308 determines whether the sheet is the second sheet of the bundle. If it is determined that the sheet is the second sheet of the bundle, in step S306, the discharge path switching control unit 320 switches the discharge conveyance switching flapper 102 to the sheet S2 to the lower discharge conveyance path 110. In step S307, if the conveyance control unit 308 determines that the sheet S2 has reached the lower discharge conveyance downstream roller 121, the sheet stop control unit 321 operates the lower discharge conveyance downstream clutch 332 in step S308. Then, the lower discharge conveyance downstream roller 121 is stopped, and the sheet S2 is stopped in the lower discharge conveyance path 110.

Figure 12A:
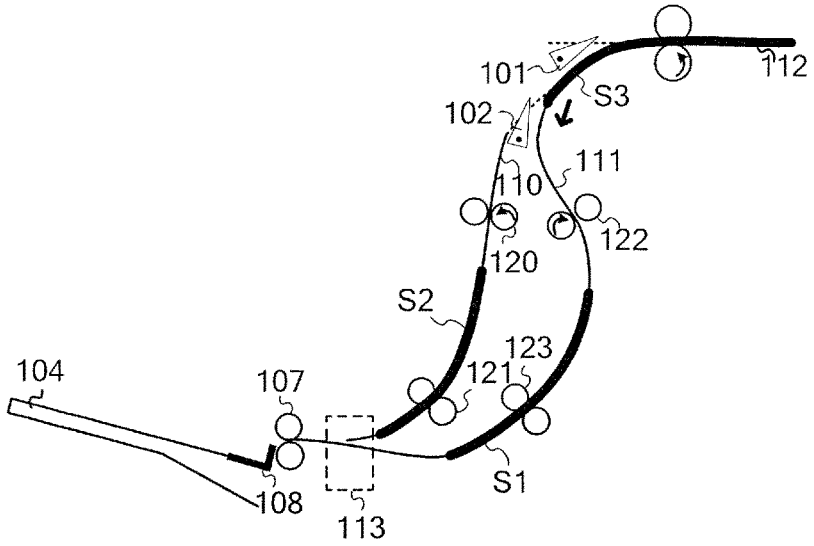
FIG. 12A is a schematic diagram showing a positional relationship of the sheets, in which the leading edge of a third sheet is conveyed to a branch portion between a retreat conveyance path and a lower discharge conveyance path.
Figure 12B:
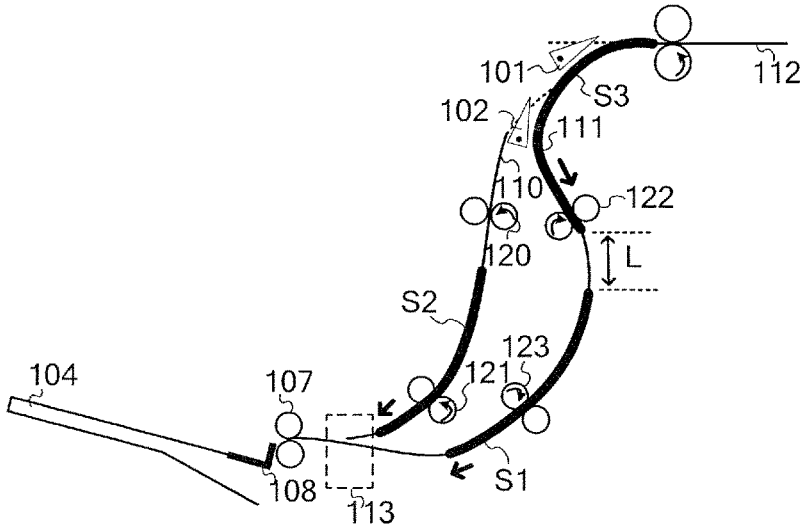
FIG. 12B is a schematic diagram showing a positional relationship of the sheets, in which a distance between the leading edge of the third sheet and the trailing edge of the first sheet is a predetermined distance or less.

Next, conveyance control of the third sheet S3 in the bundle will be described. In step S301 and step S305, the conveyance control unit 308 determines that the sheet is not the first and second sheets of the bundle, and in step S309, the conveyance control unit 308 determines whether the sheet is the third sheet of the bundle. If it is determined that the sheet is the third sheet of the bundle, in step S310, the discharge path switching control unit 320 switches the discharge conveyance switching flapper 102 to send the sheet S3 to the retreat conveyance path 111. FIG. 12A shows the sheet S1 when stopped in the retreat conveyance path 111, the sheet S2 when stopped in the lower discharge conveyance path 110, and the sheet S3 conveyed to the retreat conveyance path. In step S311, when the conveyance control unit 308 determines that the distance between the leading edge of the sheet S3 and the trailing edge of the sheet S1 is within a predetermined distance L, in step S312, the sheet stop control unit 321 releases the retreat conveyance downstream clutch 333. Then, the retreat conveyance downstream roller 123 is rotated, and the conveyance of the sheet S1 is resumed so that the sheet S3 and the sheet S1 do not contact each other. In the present embodiment, considering the response time of the retreat conveyance downstream clutch 333, it is determined that the distance between the leading edge of the sheet S3 and the trailing edge of the sheet S1 is within the predetermined distance L when the distance is within 20 mm. Then, the lower discharge conveyance downstream clutch 332 is released in accordance with the release of the retreat conveyance downstream clutch 333 of the sheet S1 so that the sheet S1 and the sheet S2 overlap at the lower discharge merging point 113. Then, the lower discharge conveyance downstream roller 121 is rotated to resume conveyance of the sheet S2. FIG. 12B is a diagram in which the sheet S3 is conveyed to the retreat conveyance path 111, and the conveyance of the sheet S1 and the conveyance of the sheet S2 are resumed so that the sheet S3 and the sheet S1 do not come into contact with each other.

Figure 12C:
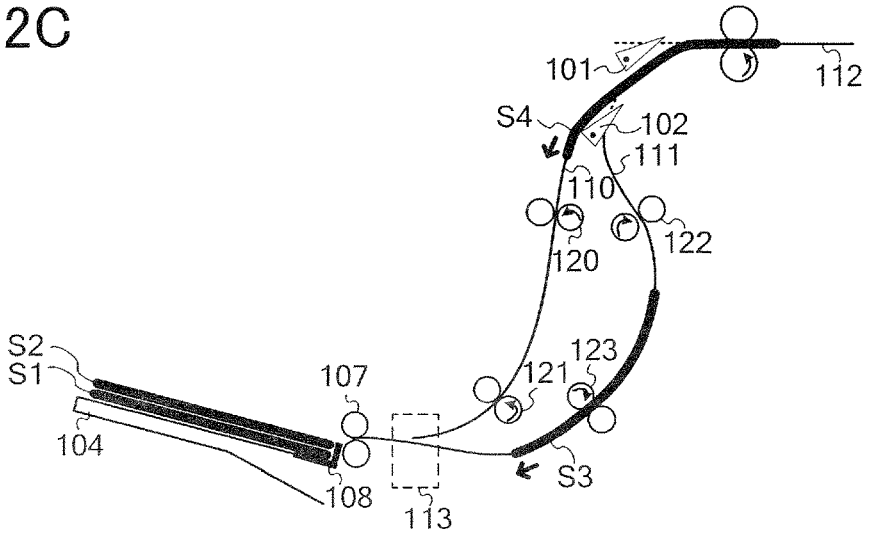
FIG. 12C is a schematic diagram showing a positional relationship of the sheets, in a state where a fourth sheet has been conveyed.

Next, the conveyance of a fourth sheet S4 in the bundle will be described. If the conveyance control unit 308 determines that the sheet is the fourth sheet of the bundle in step S309, the discharge path switching control unit 320 switches the discharge conveyance switching flapper 102 to send the sheet to the lower discharge conveyance path 110 in step S313. FIG. 12C shows a position when the fourth sheet S4 of the bundle is conveyed to the lower discharge conveyance path 110. A fifth and subsequent sheets are also sent to the lower discharge conveyance path 110 in the same manner as the sheet S4.

By conveying the sheets in this way, the time from when the sheet S1 stops in the retreat conveyance path 111 until the leading edge of the sheet S3 reaches the trailing edge of the sheet S1 can be assigned to the post-processing time of the preceding bundle. In the case where the sheet of the third bundle to be post-processed is received following the second bundle, each sheet is sent to the post-processing unit 211 according to the flowchart of FIG. 11 like the second bundle.

As described above, according to the present invention, in a configuration in which the post-process is performed on a plurality of overlapped sheets by merging sheets that have passed through different conveyance paths, it is possible to increase the time during which the post-process can be performed without reducing productivity.

In the present embodiment, the lower discharge conveyance downstream roller 121 can be said to be a first sheet conveyance unit that conveys a sheet in the first sheet conveyance path. The retreat conveyance downstream roller 123 can be said to be a second sheet conveyance unit that conveys the sheet in the second sheet conveyance path and can be driven independently from the first sheet conveyance unit. The control unit (303) temporarily stops the first sheet (S1) in the second sheet conveyance path, and temporarily stops the second sheet in the first sheet conveyance path. Then, it can be said that the first and second sheet conveyance units are controlled so as to release the stop of the first and second sheets before the leading edge of the third sheet (S3) following the second sheet reaches the trailing edge of the first sheet.

Fourth Embodiment

Next, a fourth embodiment according to the present invention will be described. In the following description, only points different from the third embodiment will be described, and other points will be denoted by the same reference numerals as those in the first to third embodiments, and description thereof will be omitted. The hardware configuration and control block for realizing the present embodiment are the same as those in the third embodiment. A case will be described in which the length of the sheet to be conveyed is different from that of the third embodiment, and two sheets are input in the retreat conveyance path 111. Further, the following description will be given by taking the conveyance control of sheets of the second bundle as an example as in the third embodiment.

Figure 13:
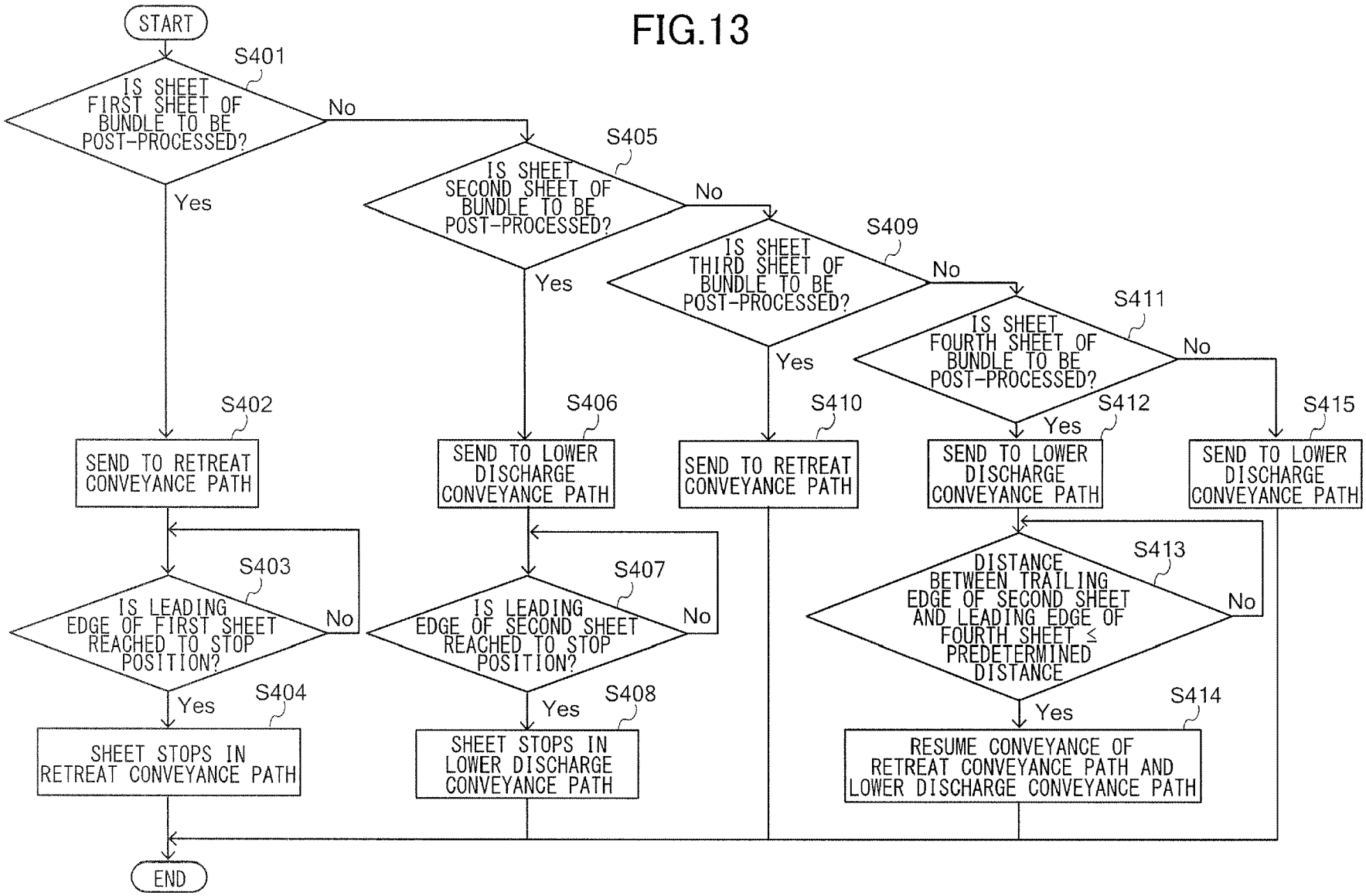
FIG. 13 is a control flowchart of sheet conveyance in a fourth embodiment.

FIG. 13 is a flowchart of the switching control of the lower discharge conveyance path 110 and the retreat conveyance path 111 by the conveyance control unit 308 in conveying the sheets of the second bundle and the sheet stop control in the conveyance path. The conveyance control of the first and second sheets of the second bundle (S401 to S408) is the same as S301 to S308 of FIG. 11 described in the third embodiment, and the description thereof is omitted.

Figure 14A:
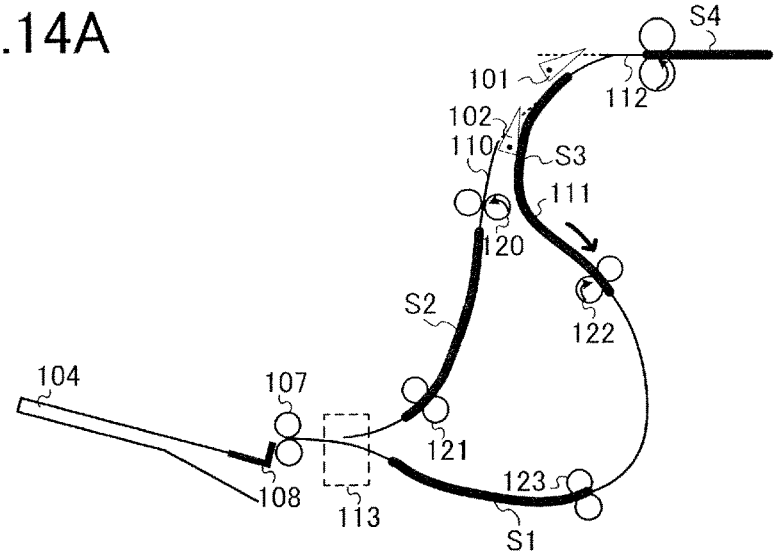
FIG. 14A is a schematic diagram showing a positional relationship of the sheets, in a state where the third sheet is guided to the retreat conveyance path.

The conveyance control of the third sheet S3 of the second bundle will be described. In step S401 and step S405, the conveyance control unit 308 determines that the sheet is not the first and second sheets of the bundle, and in step S409, the conveyance control unit 308 determines whether the sheet is the third sheet of the bundle. If it is determined that the sheet is the third sheet of the bundle, in step S410, the discharge path switching control unit 320 switches the discharge conveyance switching flapper 102 to send the sheet S3 to the retreat conveyance path 111. FIG. 14A is a diagram in which the sheet S1 stops at the retreat conveyance path 111, the sheet S2 stops at the lower discharge conveyance path 110, and the sheet S3 is conveyed to the retreat conveyance path 111.

Next, conveyance control of the fourth sheet S4 of the second bundle will be described. In step S409, the conveyance control unit 308 determines that the sheet is not the third sheet of the bundle, and in step S411, the conveyance control unit 308 determines whether the sheet is the fourth sheet of the bundle. If it is determined that the sheet is the fourth sheet of the bundle, the discharge path switching control unit 320 switches the discharge conveyance switching flapper 102 to send the sheet S4 to the lower discharge conveyance path 110 in step S412.

Figure 14B:
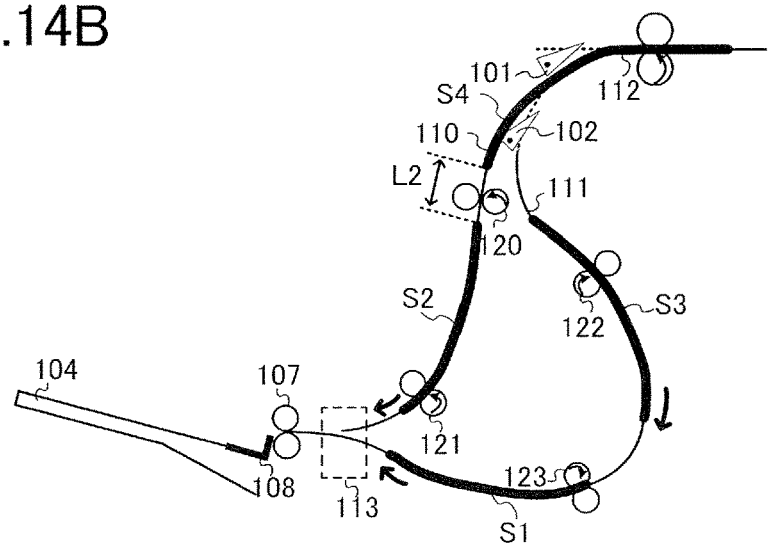
FIG. 14B is a schematic diagram showing a positional relationship of the sheets, in which a distance between the leading edge of the fourth sheet and the trailing edge of the second sheet is a predetermined distance or less.

In step S413, if the conveyance control unit 308 determines that the distance between the leading edge of the sheet S4 and the trailing edge of the sheet S2 is within the predetermined distance L2, the sheet stop control unit 321 releases the lower discharge conveyance downstream clutch 332 in step S414. Then, the lower discharge conveyance downstream roller 121 is rotated, and conveyance of the sheet S2 is resumed so that the sheet S4 and the sheet S2 do not contact each other. The retreat conveyance downstream clutch 333 is released in accordance with the release of the lower discharge conveyance downstream clutch 332 so that the sheet S2 and the sheet S1 overlap at the lower discharge merging point 113. In the present embodiment, considering the response time of the lower discharge conveyance downstream clutch 332, it is determined that the distance between the leading edge of the sheet S4 and the trailing edge of the sheet S2 the distance is within a predetermined distance L2 when the distance is within 20 mm. FIG. 14B is a diagram in which conveyance of the sheet S1 and the sheet S2 is resumed so that the sheet S4 and the sheet S2 do not come into contact with each other. Thereafter, the sheet S3 and the sheet S4 are conveyed so as to overlap at the lower discharge merging point 113 and are sent to the post-processing unit 211.

Figure 14C:
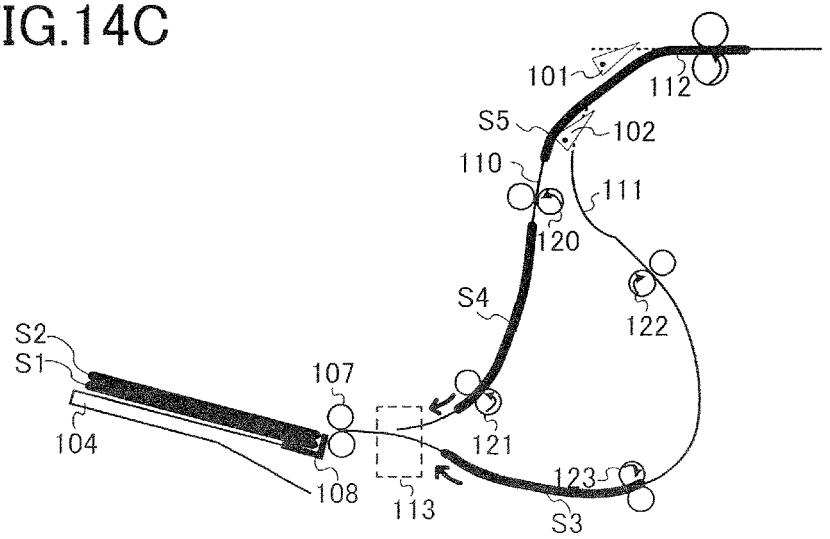
FIG. 14C is a schematic diagram showing a positional relationship of the sheets, in a state where a fifth sheet has been conveyed.

Next, conveyance control of a fifth and subsequent sheets of the bundle will be described. If the conveyance control unit 308 determines that the sheet is the fifth or subsequent sheet of the bundle in step S411, the discharge path switching control unit 320 switches the discharge conveyance switching flapper 102 to send the sheet to the lower discharge conveyance path 110 in step S415. Then, the sheet is sent to the post-processing unit without being stopped in the lower discharge conveyance path 110. FIG. 14C shows a position when a fifth sheet S5 of the bundle is conveyed to the lower discharge conveyance path 110. Similarly to the sheet S5, a sixth and subsequent sheets are also sent to the lower discharge conveyance path 110.

By conveying the sheets in this way, the time from when the sheet S1 stops in the retreat conveyance path 111 until the leading edge of the sheet S4 reaches the trailing edge of the sheet S2 existing in the lower discharge conveyance path 110 can be assigned to the post-processing time of the bundle. In the case where the sheet of the third bundle to be post-processed is received following the second bundle, each sheet is sent to the post-processing unit 211 according to the flowchart of FIG. 13 like the second bundle.

As described above, according to the present invention, in a configuration in which the post-process is performed on a plurality of overlapped sheets by merging sheets that have passed through different conveyance paths, it is possible to increase the time during which the post-process can be performed without reducing productivity.

In other words, in the present embodiment, it can be said that the control unit (303) controls the first and second sheet conveyance units so as to release the stop of first and second sheets before the leading edge of the fourth sheet (S4) reaches the trailing edge of the second sheet.

In the present embodiment, the case where the fourth sheet reaches the trailing edge of the second sheet has been described, but depending on the apparatus configuration, the third sheet may reach the trailing edge of the first sheet first. In the case of such a configuration, S413 and S414 in the flow of FIG. 13 are processed subsequent to S410, and the same effect can be obtained by performing the processing of S413 on the first and third sheets.

Figure 15:
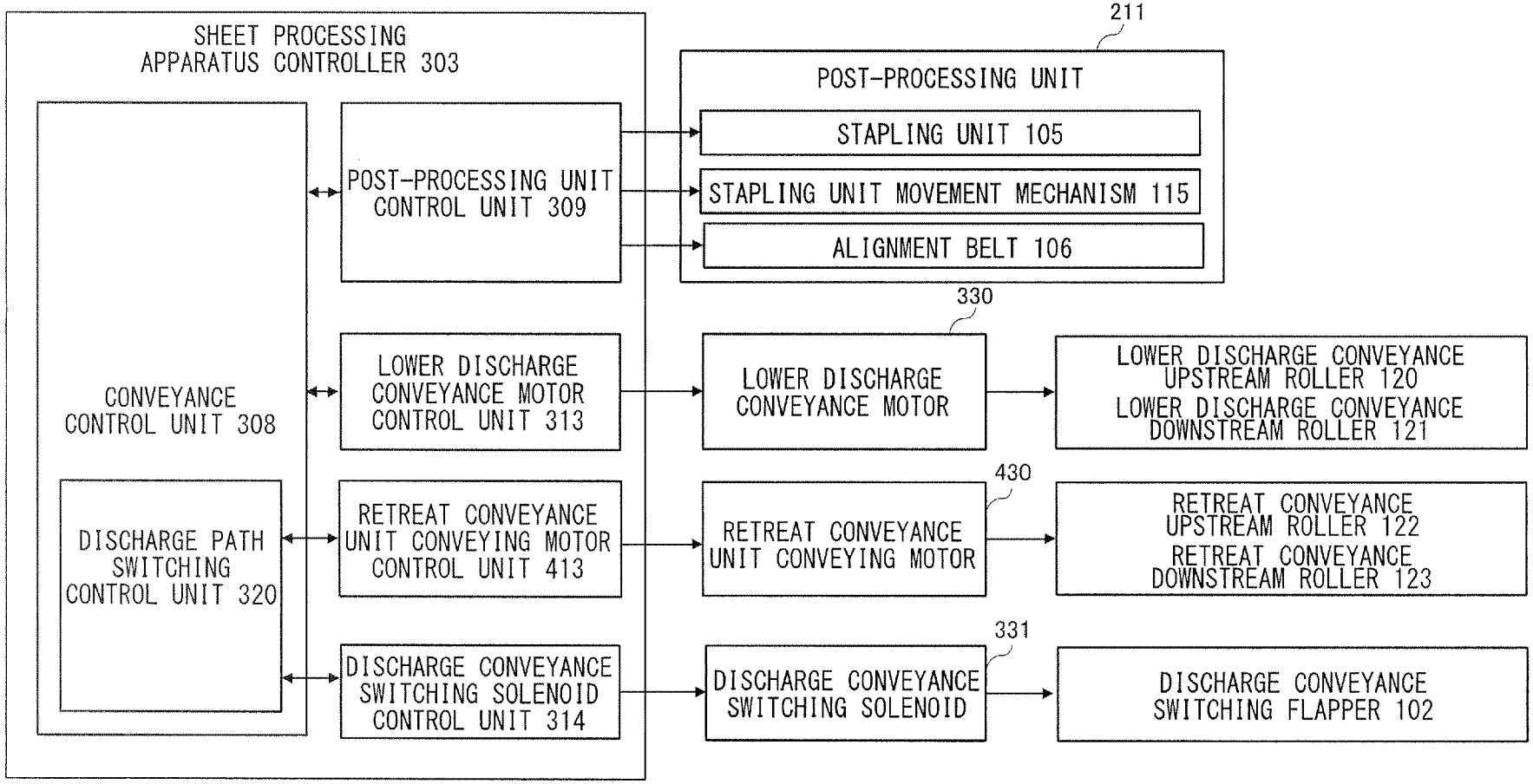
FIG. 15 is a diagram showing another example of a functional block diagram of the sheet processing apparatus.

In addition, in the above-described embodiment, the example in which the lower discharge conveyance upstream roller 120, the lower discharge conveyance downstream roller 121, the retreat conveyance upstream roller 122, and the retreat conveyance downstream roller 123 are the same drive source has been described. However, the present embodiment is not limited to these configurations. For example, the discharge conveyance upstream roller 120 and the lower discharge conveyance downstream roller 121, and the retreat conveyance upstream roller 122 and the retreat conveyance downstream roller 123 may be driven by independent motors. Their speeds may be each independently set so that the two sheets can overlap. A control block diagram in this case is shown in FIG. 15. In FIG. 15, a retreat conveyance unit conveying motor control unit 413 and a retreat conveyance unit conveying motor 430 are provided, and thereby the retreat conveyance upstream roller 122 and the retreat conveyance downstream roller 123 are driven. The description of the other configuration is the same as in FIG. 3. In the present configuration, the speed of the retreat conveyance unit conveying motor 430 is controlled so that the sheet conveying speed by the retreat conveyance upstream roller 122 and the retreat conveyance downstream roller 123 is slower than the sheet conveying speed by the lower discharge conveyance upstream roller 120 and the lower discharge conveyance downstream roller 121. For this reason, the two sheets overlap at the lower discharge merging point 113.

For example, in the case where all rollers are driven by different drive sources, the sheet S1 may be stopped in the retreat conveyance path 111 by stopping the drive source of the retreat conveyance downstream roller 123 without using the retreat conveyance downstream clutch 333. The sheet S2 may be stopped in the lower discharge conveyance path 110 by stopping the drive source of the lower discharge conveyance downstream roller 121 without using the lower discharge conveyance downstream clutch 332. In the embodiment in which the conveyance of the sheet can be independently controlled in the lower discharge conveyance path 110 and the retreat conveyance path 111, depending on the difference in conveying speed caused by the wear in each conveyance path 110, 111, the conveying speed of the sheet in each conveyance path 110, 111 may be changed. In this case, it is not necessary to disperse the sheets in the conveyance paths 110 and 111.

Furthermore, in the above-described embodiment, the image forming system that forms an image by the electrophotographic system has been described as an example, but the present invention is not limited thereto, and the present invention may be applied to an image forming system that forms an image by using an inkjet method. The present invention has been described with an example in which the sheet processing apparatus controller 303 controls the sheet processing apparatus 100, but a part or all of the control may be controlled by the controller on the image forming apparatus 1 side. That is, in the present embodiment, whether on the sheet processing apparatus 100 side or on the image forming apparatus 1 side, the controller on the sheet processing apparatus side and the image forming apparatus side may cooperate to form a control unit. Furthermore, the above-described embodiments may be combined in any way.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-228587, filed Dec. 5, 2018, and Japanese Patent Application No. 2019-170399, filed Sep. 19, 2019 which are hereby incorporated by reference herein in their entirety.

What is claimed is:

1. A sheet processing apparatus comprising:

a sheet supporting portion configured to support a discharged sheet;

a sheet processing unit configured to perform processing on a sheet bundle composed of a plurality of sheets discharged on the sheet supporting portion;

a first sheet conveyance path for guiding the sheet to the sheet supporting portion;

a second sheet conveyance path that branches from the first sheet conveyance path at a branch portion on the first sheet conveyance path and merges with the first sheet conveyance path at a merging portion upstream, in a sheet conveying direction, of a discharge port to the sheet supporting portion;

a guide unit configured to selectively guide the sheet to the first sheet conveyance path or the second sheet conveyance path in the branch portion; and a control unit configured to control the guide unit, wherein a path length of the second sheet conveyance path between the branch portion and the merging portion is longer than a path length of the first sheet conveyance path between the branch portion and the merging portion, and wherein the control unit controls the guide unit so as to guide a first sheet conveyed first in the sheet bundle to be processed by the sheet processing unit to the second sheet conveyance path, and guide a second sheet following the first sheet to the first sheet conveyance path to merge the first and second sheets in an overlapping manner at the merging portion, and guide at least one of sheets following the second sheet among a plurality of sheets constituting the sheet bundle to the second sheet conveyance path.

2. The sheet processing apparatus according to claim 1, wherein the control unit controls the guide unit so as to guide the sheets following the second sheet among the plurality of sheets constituting the sheet bundle alternatively to the first sheet conveyance path and the second sheet conveyance path in units of the number of sheets.

3. The sheet processing apparatus according to claim 1, wherein the control unit controls the guide unit so as to guide a last sheet among the plurality of sheets constituting the sheet bundle to the first sheet conveyance path.

4. The sheet processing apparatus according to claim 1, wherein the control unit controls the guide unit so as to balance a relationship between the number of sheets to be sent to the first sheet conveyance path and the number of sheets to be sent to the second sheet conveyance path out of the total number of sheets to be conveyed during an input sheet processing job.

5. The sheet processing apparatus according to 1, further comprising:

a first sheet conveyance unit configured to convey the sheet in the first sheet conveyance path; and a second sheet conveyance unit configured to convey the sheet in the second sheet conveyance path and be driven independently of the first sheet conveyance unit.

6. The sheet processing apparatus according to claim 5, wherein the control unit controls the first and second sheet conveyance units such that a sheet conveying speed in the second sheet conveyance path is slower than a sheet conveying speed in the first sheet conveyance path.

7. The sheet processing apparatus according to claim 5, wherein the control unit controls the second sheet conveyance unit so as to temporarily stop the sheet in the second sheet conveyance path.

8. The sheet processing apparatus according to claim 7, wherein the control unit controls the guide unit so as to guide a third sheet following the second sheet to the second sheet conveyance path, and the control unit controls the first and second sheet conveyance units so as to temporarily stop the first sheet in the second sheet conveyance path, temporarily stop the second sheet in the first sheet conveyance path, and release the stop of the first and second sheets before a leading edge of the third sheet reaches a trailing edge of the first sheet.

9. The sheet processing apparatus according to claim 8, wherein the control unit controls the guide unit so as to guide a fourth sheet following the third sheet to the first sheet conveyance path, and the control unit controls the first and second sheet conveyance units so as to release the stop of the first and second sheets before a leading edge of the fourth sheet reaches a trailing edge of the second sheet.

10. A sheet processing apparatus comprising:

a sheet supporting portion configured to support a discharged sheet;

a sheet processing unit configured to perform processing on a sheet bundle composed of a plurality of sheets discharged on the sheet supporting portion;

a first sheet conveyance path for guiding the sheet to the sheet supporting portion;

a second sheet conveyance path that branches from the first sheet conveyance path at a branch portion on the first sheet conveyance path and merges with the first sheet conveyance path at a merging portion upstream, in a sheet conveying direction, of a discharge port to the sheet supporting portion;

a guide unit configured to selectively guide the sheet to the first sheet conveyance path or the second sheet conveyance path in the branch portion; and a control unit configured to control the guide unit, wherein the control unit controls the guide unit so as to guide a first sheet conveyed first in the sheet bundle to be processed by the sheet processing unit to the second sheet conveyance path, and guide a second sheet following the first sheet to the first sheet conveyance path to merge the first and second sheets in an overlapping manner at the merging portion, and guide at least one of sheets following the second sheet among a plurality of sheets constituting the sheet bundle to the second sheet conveyance path, and wherein the sheet processing unit is in a non-processing state of not performing the processing on a sheet bundle on the sheet supporting portion, when a leading edge of the sheet to be guided to the second sheet conveyance path reaches the branch portion among the sheets following the second sheet.

11. An image forming system comprising:

an image forming unit configured to form an image on a sheet;

a sheet supporting portion on which a sheet on which the image is formed by the image forming unit is discharged and supported;

a sheet processing unit configured to perform processing on a sheet bundle composed of a plurality of sheets discharged on the sheet supporting portion;

a first sheet conveyance path for guiding the sheet to the sheet supporting portion;

a second sheet conveyance path that branches from the first sheet conveyance path at a branch portion on the first sheet conveyance path and merges with the first sheet conveyance path at a merging portion upstream, in a sheet conveying direction, of a discharge port to the sheet supporting portion;

a guide unit configured to selectively guide the sheet to the first sheet conveyance path or the second sheet conveyance path in the branch portion; and a control unit configured to control the guide unit, wherein a path length of the second sheet conveyance path between the branch portion and the merging portion is longer than a path length of the first sheet conveyance path between the branch portion and the merging portion, and wherein the control unit controls the guide unit so as to guide a first sheet conveyed first in the sheet bundle to be processed by the sheet processing unit to the second sheet conveyance path, and guide a second sheet following the first sheet to the first sheet conveyance path to merge the first and second sheets in an overlapping manner at the merging portion, and guide at least one of sheets following the second sheet among a plurality of sheets constituting the sheet bundle to the second sheet conveyance path.

* * * * *